US010767894B1

(12) United States Patent
Baldwin et al.

(10) Patent No.: US 10,767,894 B1
(45) Date of Patent: Sep. 8, 2020

(54) AIR REGISTER

(71) Applicants: Jeffrey Baldwin, Anthem, AZ (US); Ryan Liebengood, Gilbert, AZ (US)

(72) Inventors: Jeffrey Baldwin, Anthem, AZ (US); Ryan Liebengood, Gilbert, AZ (US)

( * ) Notice: Subject to any disclaimer, the term of this patent is extended or adjusted under 35 U.S.C. 154(b) by 122 days.

(21) Appl. No.: 16/029,642

(22) Filed: Jul. 8, 2018

Related U.S. Application Data

(63) Continuation of application No. 15/136,937, filed on Apr. 24, 2016, now Pat. No. 10,018,374.

(60) Provisional application No. 62/152,034, filed on Apr. 24, 2015, provisional application No. 62/276,920, filed on Jan. 10, 2016.

(51) Int. Cl.

| | |
|---|---|
| ***F24F 13/14*** | (2006.01) |
| ***F24F 11/79*** | (2018.01) |
| ***F24F 13/15*** | (2006.01) |
| ***F24F 13/08*** | (2006.01) |
| *F24F 11/56* | (2018.01) |
| *F24F 11/58* | (2018.01) |

(52) U.S. Cl.
CPC ..... *F24F 13/1406* (2013.01); *F24F 11/79* (2018.01); *F24F 13/084* (2013.01); *F24F 13/15* (2013.01); *F24F 11/56* (2018.01); *F24F 11/58* (2018.01)

(58) Field of Classification Search
CPC ..... F24F 13/1406; F24F 13/1413
USPC ..... 454/318, 152–155, 273, 290, 270–271, 454/319, 325–326, 330, 307, 164
See application file for complete search history.

(56) References Cited

U.S. PATENT DOCUMENTS

| | | | | | |
|---|---|---|---|---|---|
| 3,123,098 | A * | 3/1964 | Bishop | F24F 13/15 | 137/601.06 |
| 3,125,944 | A * | 3/1964 | Radcliff | F24F 13/15 | 49/51 |
| 3,530,782 | A | 9/1970 | Ardussi | | |
| 3,547,152 | A * | 12/1970 | Hess | F24F 13/10 | 137/601.06 |
| 3,746,042 | A * | 7/1973 | Finkel | F24F 13/14 | 137/601.06 |
| 4,060,024 | A * | 11/1977 | Deck | F24F 13/15 | 454/319 |
| 5,971,847 | A | 10/1999 | Webb | | |
| 2016/0123621 | A1 | 5/2016 | Perrie et al. | | |

* cited by examiner

*Primary Examiner* — Vivek K Shirsat
(74) *Attorney, Agent, or Firm* — Booth Udall Fuller, PLC

(57) ABSTRACT

An air register including a body having a front plate with a front surface, a rear surface, and at least one opening extending from the front surface to the rear surface, an upper air dam having a leading edge and a trailing edge, a lower air dam having a leading edge and a trailing edge, an air flow control mechanism operatively connected to the upper air dam or the lower air dam rotate both the upper air dam and the lower air dam simultaneously, and wherein the upper air dam and the lower air dam rotate in opposite directions upon operation of the air flow control mechanism.

20 Claims, 32 Drawing Sheets

AIR REGISTER

CROSS-REFERENCE TO RELATED APPLICATIONS

This application claims priority to U.S. patent application Ser. No. 15/136,937 filed on Apr. 24, 2016, which issued as U.S. Pat. No. 10,018,374 on Jul. 10, 2018, U.S. Provisional Patent Application No. 62/152,034, filed on Apr. 24, 2015 to Baldwin et al., and U.S. Provisional Patent Application No. 62/276,920, filed on Jan. 10, 2016 to Baldwin et al., the disclosures of which are hereby incorporated herein by reference.

BACKGROUND

Air registers are well known in both household and commercial HVAC systems. The air register is an instrumental component of HVAC systems because it controls air flow direction, volume, and velocity which can be adjusted by modifying the orientation and position of the various vanes and louvers. The air register is connected to the structures mounting surface, usually drywall or other suitable material, or the air duct. The air duct is then connected to the air handler and other HVAC components. Air registers operate in several forms, with rotary dials, levers, or other mechanical structures. Some air registers may pivot, slide, or utilize other relative movement to open or close the air duct opening.

SUMMARY

Aspects of this disclosure relate to an air register. In one aspect, an air register includes a body having a front plate with a front surface, a rear surface, and at least one opening extending from the front surface to the rear surface, a plurality of louvers positioned rearward of the front plate and the rear surface and movable from an open position to permit air flow through the air register to a closed position to restrict air flow through the air register, and wherein each of the plurality of louvers includes at least one gasket compressible when the air register is in the closed position.

In an implementation, each of the plurality of louvers further includes a front surface and a rear surface and the at least one gasket is positioned on an upper portion of the louver front surface. The air register may further include an upper mounting tab extending rearward from the front plate and a lower mounting tab extending rearward from the front plate. The lower mounting tab may further include a gasket on a forward surface which is compressible by one of the plurality of louvers when the air register is in the closed position. The at least one gasket of one of the plurality of louvers may contact a rear surface of the upper mounting tab when the air register is in the closed position. The at least one gasket may be composed of foam. The at least one gasket may be composed of rubber. The at least one gasket may be molded directly onto each of the plurality of louvers.

The air register may further include a perimeter lip extending rearward from the body and a perimeter gasket positioned adjacent the perimeter lip for sealing the air register to a mounting surface. The air register may further include a gasket flange positioned adjacent and inward of the perimeter gasket and orienting the perimeter gasket between the perimeter lip and the gasket flange. The air register may further include a plurality of vanes positioned forward of the plurality of louvers. The air register may further include a louver lever extending through the front plate and beyond the front plate front surface and the louver lever controlling the opening and closing of the plurality of louvers.

The body may further include a plurality of sidewalls extending rearward from the front plate and a sidewall gasket on at least one of the plurality of sidewalls and positioned between one of the plurality of sidewalls and the plurality of louvers. The body may further include a plurality of sidewalls extending rearward from the front plate and a first detent for a closed position of the plurality of louvers, a second detent for a fully open positon of the plurality of louvers, and a third detent for a partially open position of the plurality of louvers. The air register may further include an actuator operatively connected to the plurality of louvers to selectively open and close the plurality of louvers. The air register may further include a remote controller operatively connected to the actuator to selectively control the actuator and the plurality of louvers. The remote controller may be a separate button controlled by a user to selectively open and close the plurality of louvers. The remote controller may be connected to an air handler and wherein the remote controller engages the actuator to selectively open the plurality of louvers when the air handler is moving air and selectively close the plurality of louvers when the air handler is not moving air. The actuator may be positioned in front of the front plate front surface. The actuator may be positioned behind the plurality of louvers.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Embodiments of the present invention will hereinafter be described in conjunction with the appended drawings, where like designations denote like elements, and.

DETAILED DESCRIPTION

Figure 1:
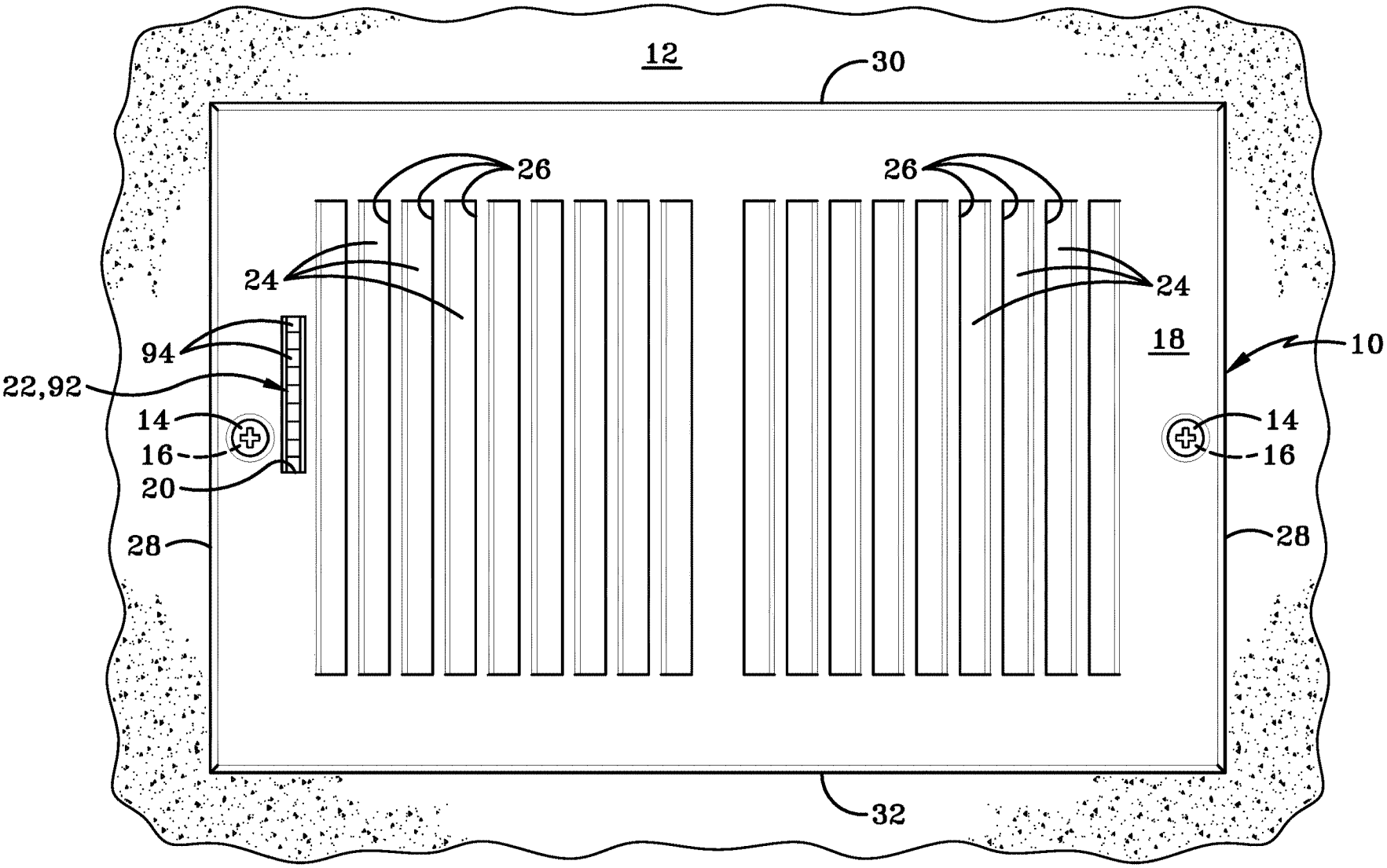
FIG. 1 is a front view of a first aspect air register mounted to a wall.
Figure 2:
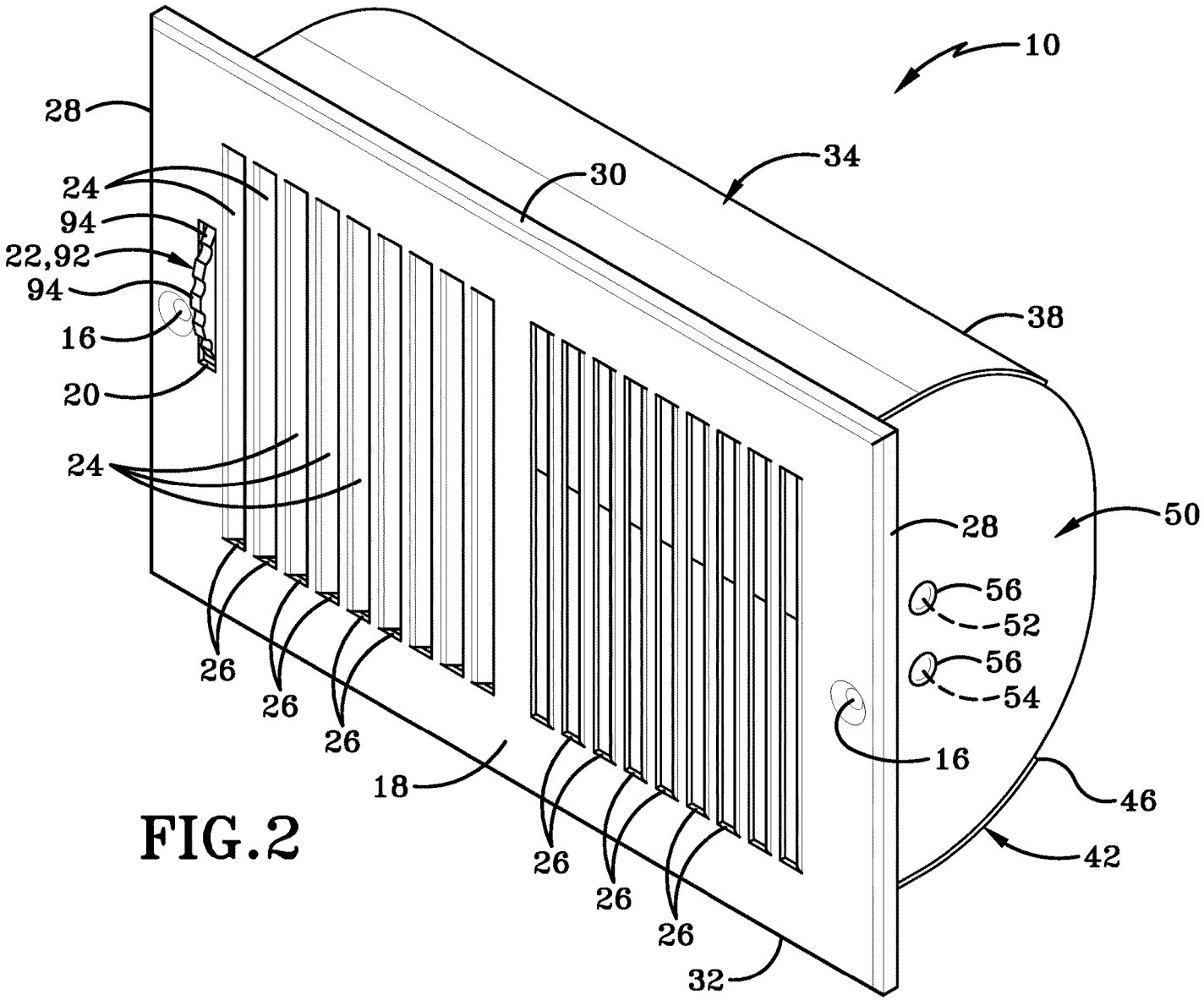
FIG. 2 is a perspective view of the first aspect air register removed from the wall.
Figure 3:
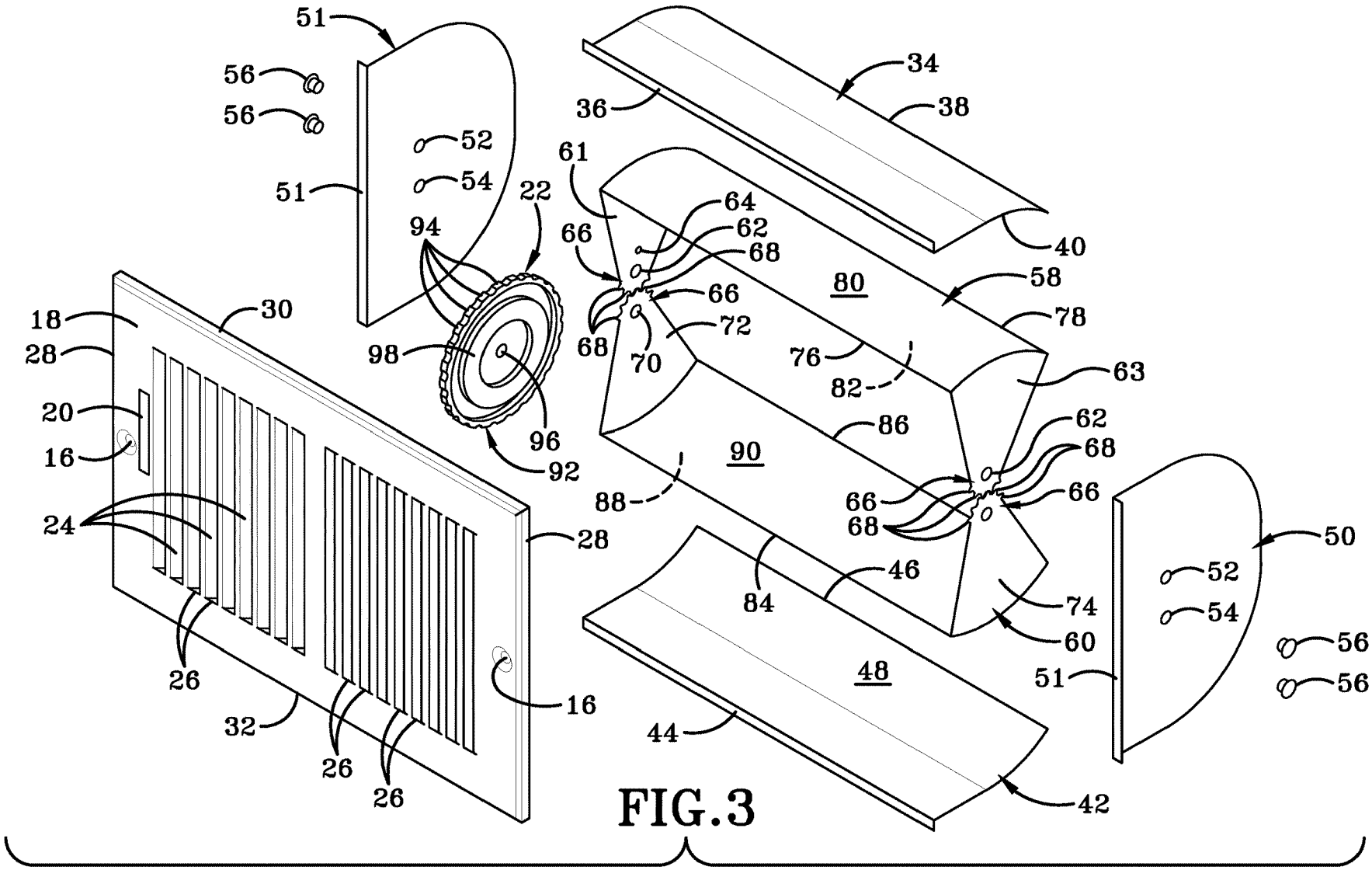
FIG. 3 is an exploded view of the first aspect air register with the air deflectors in the open position.
Figure 4:
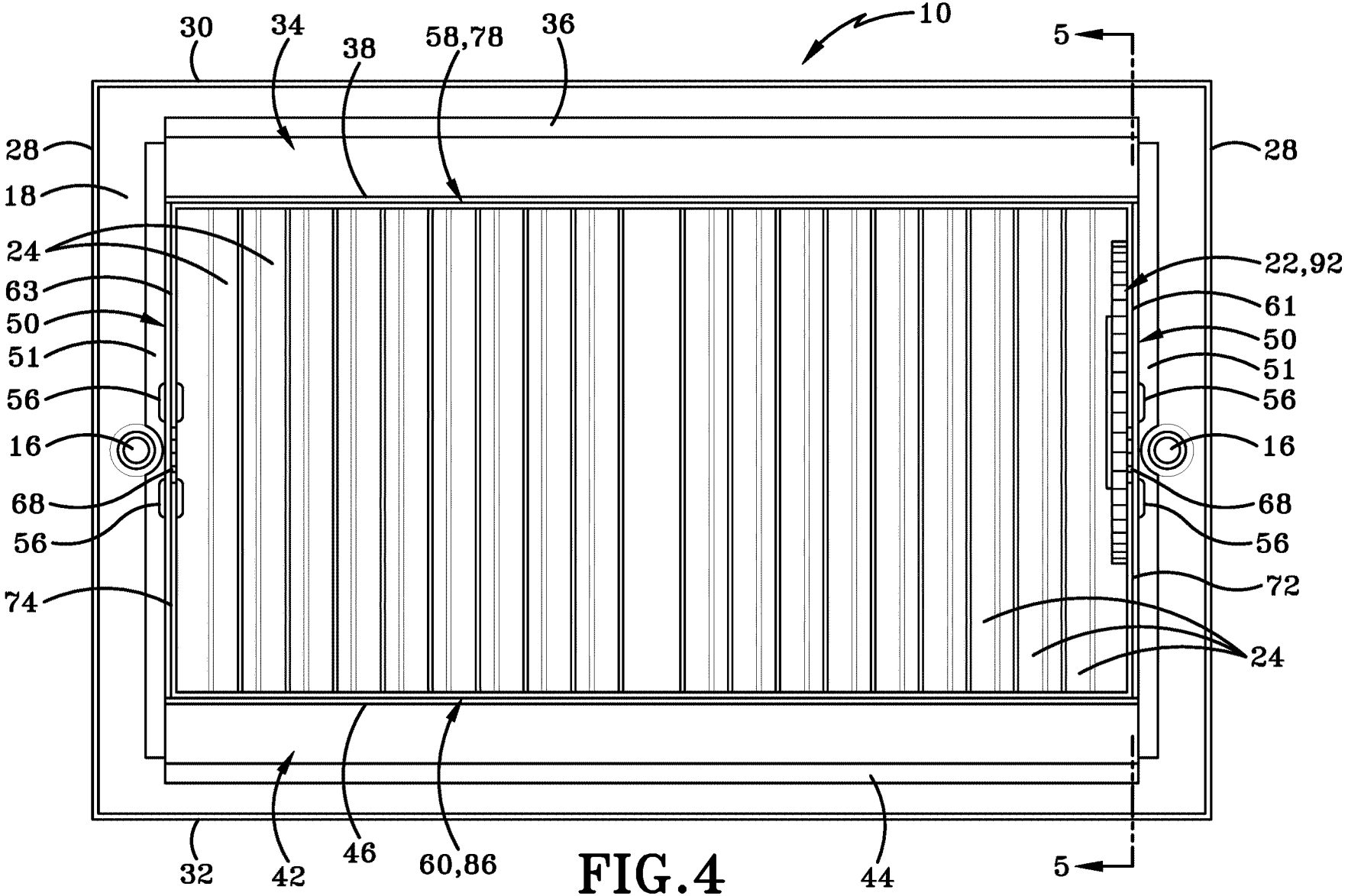
FIG. 4 is a rear view of the first aspect air register.

This disclosure, its aspects and implementations, are not limited to the specific components or assembly procedures disclosed herein. Many additional components and assembly procedures known in the art consistent with the intended operation and assembly procedures for an air register will become apparent for use with implementations of an air register from this disclosure. Accordingly, for example, although particular components are disclosed, such components and other implementing components may comprise any shape, size, style, type, model, version, measurement, concentration, material, quantity, and/or the like as is known in the art for such implementing components, consistent with the intended operation of an air register.

FIGS. 1-7 illustrate various view of a first aspect air register 10. Air register 10 is shown secured to a wall 12 with screws 14 through mounting apertures 16. Air register 10 includes a front wall 18 with an air flow controller opening 20 having an air flow controller wheel 22 which may also be a tab or other suitable lever type mechanism. Front wall 18 also includes a plurality of vanes 24 with vane slots 26 between each vane 24. Vanes 24 may be straight, angled, or oriented in any number of shapes, sizes, or orientations. Further, vanes 24 may be fixed or movable to change the flow of air there through.

Air register 10 also includes a side wall 28 on each left and right side, a top wall 30 and a bottom wall 32. An upper air deflector 34 includes a forward lip 36, a rear edge 38, and a bottom surface 40. A lower air deflector 42 includes a forward lip 44, a rear edge 46, and an upper surface 48. End caps 50 each include a forward lip 51, an upper hole 52, and a lower hole 54, whereby the upper hole and lower hole are each oriented to receive a rivet 56. Air register 10 also includes an upper air dam 58 and a lower air dam 60. Upper air dam 58 includes a pivot aperture 62 on a left side 61 and a right side 63. Left side 61 also includes a pin aperture 64 for receiving a pin, described below, and imparting rotation on the upper and lower air dams 58, 60. Both left side 61 and right side 63 terminate with rounded portions 66 having teeth 68 thereon. Similar to upper air dam 58, lower air dam 60 also includes a pivot aperture 70 on a left side 72 and a right side 74.

Upper air dam 58 also includes a leading edge 76 and a trailing edge 78 of the central portion, with an outer surface 80 and an inner surface 82. Similarly, lower air dam 60 also includes a leading edge 84 and a trailing edge 86 of the central portion, with an outer surface 88 and an inner surface 90. Air flow controller wheel 22 includes a perimeter portion 92 with ridges 94 and a central aperture 96. A standoff portion 98 is positioned radially between the central aperture 96 and perimeter portion 92. A pin 100 extends outward from air flow controller wheel 22 and fits within pin aperture 64 to provide pivotable movement of both upper air dam 58 and lower air dam 60 as will be described in greater detail below.

Figure 5:
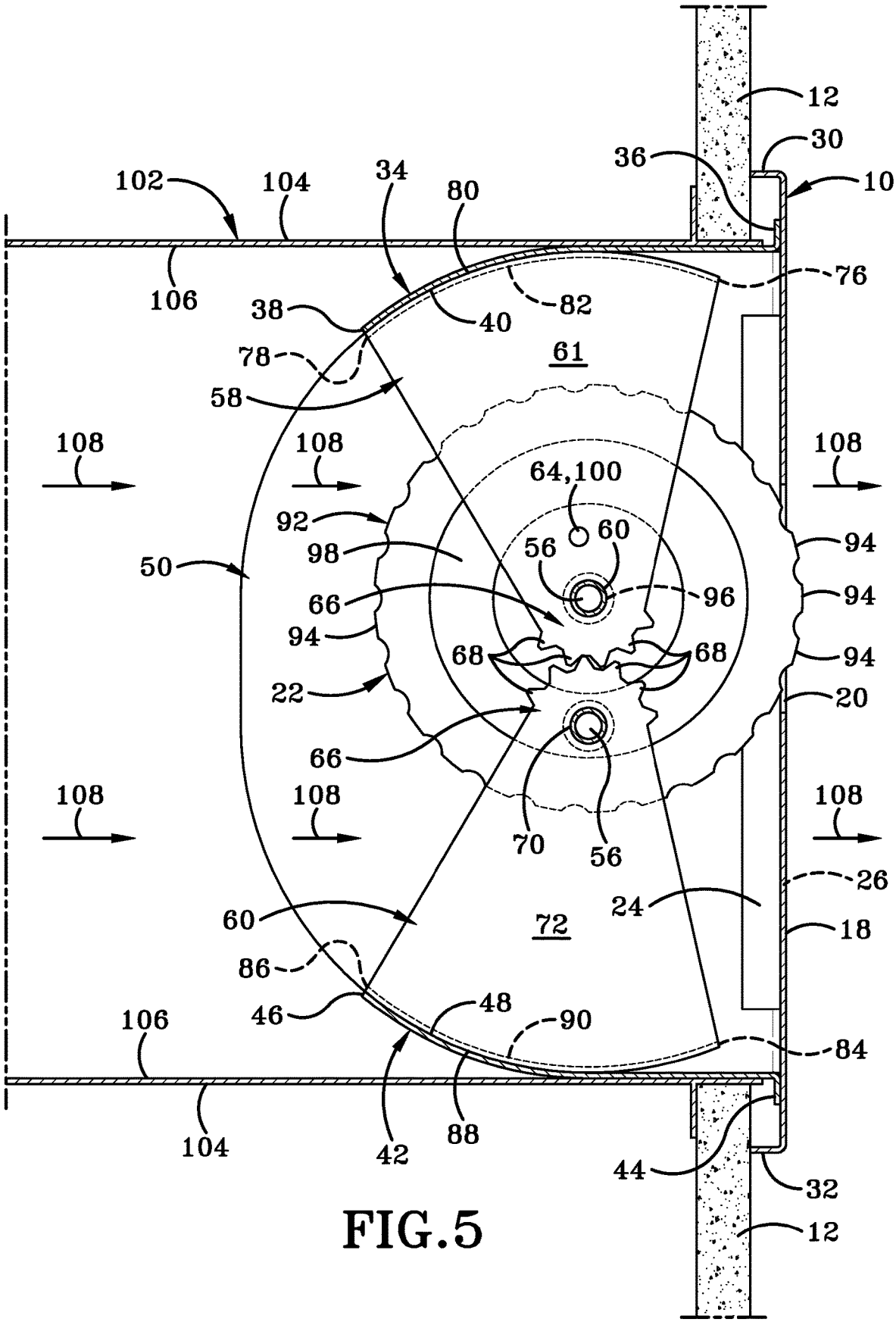
FIG. 5 is a sectional view taken generally about line 5-5 in FIG. 4.
Figure 6:
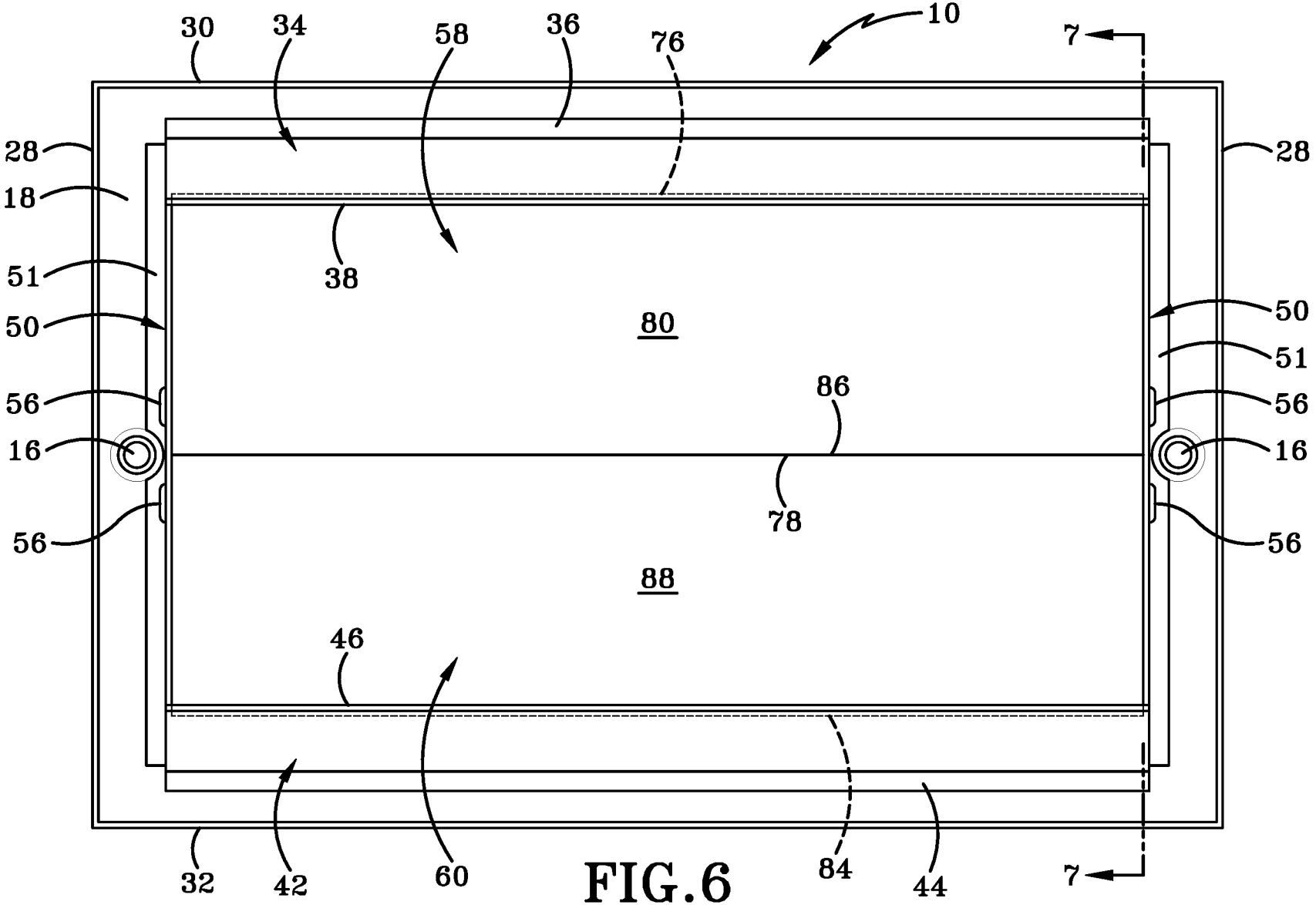
FIG. 6 is a rear view of the first aspect air register with the air deflectors in the closed position.

FIG. 5 also illustrates duct work 102 having an outer surface 104 and inner surface 106 into which air register 10 is installed along wall 12. Further, FIG. 5 illustrates air register 10 and particularly upper air dam 58 and lower air dam 60 in the open position such that air flow 108 can pass there through. In this instance, air register 10 is shown fully open with the air dams nearly 180 degrees apart from each other.

In operation, the upper and lower air dams pivot about respective rivets 56. The pin 100 of air flow controller wheel 22 is positioned within upper air dam 58 pin aperture 62 and when wheel 22 is rotated, a rotational movement is also imparted on upper air dam 58 such that teeth or gears 68 impart movement on lower air dam 60. Accordingly, when the air flow controller wheel is rotated, the upper and lower air dams are also pivoted from the open to closed or closed to open positions.

Figure 7:
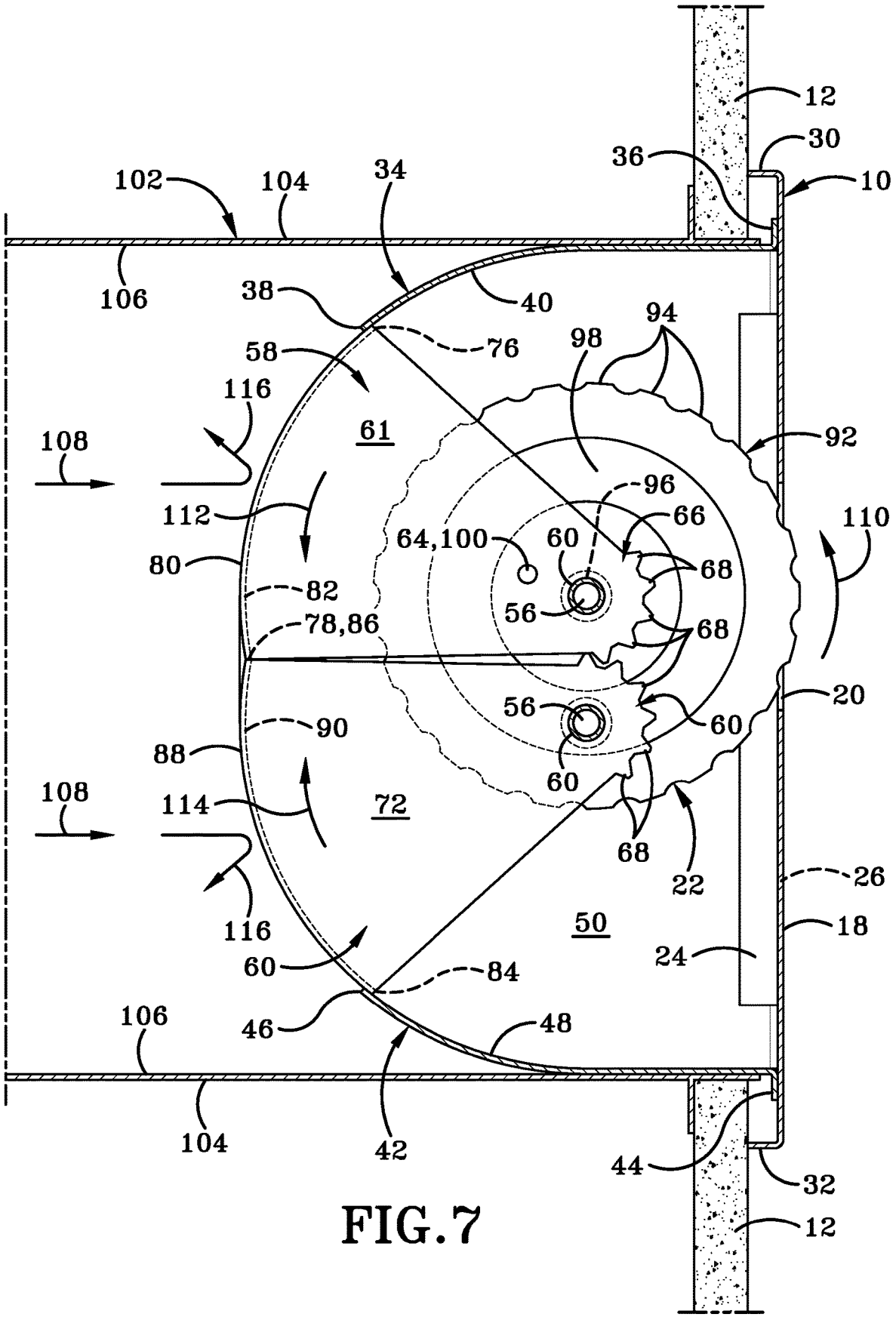
FIG. 7 is a sectional view taken generally about line 7-7 in FIG. 6.
Figure 8:
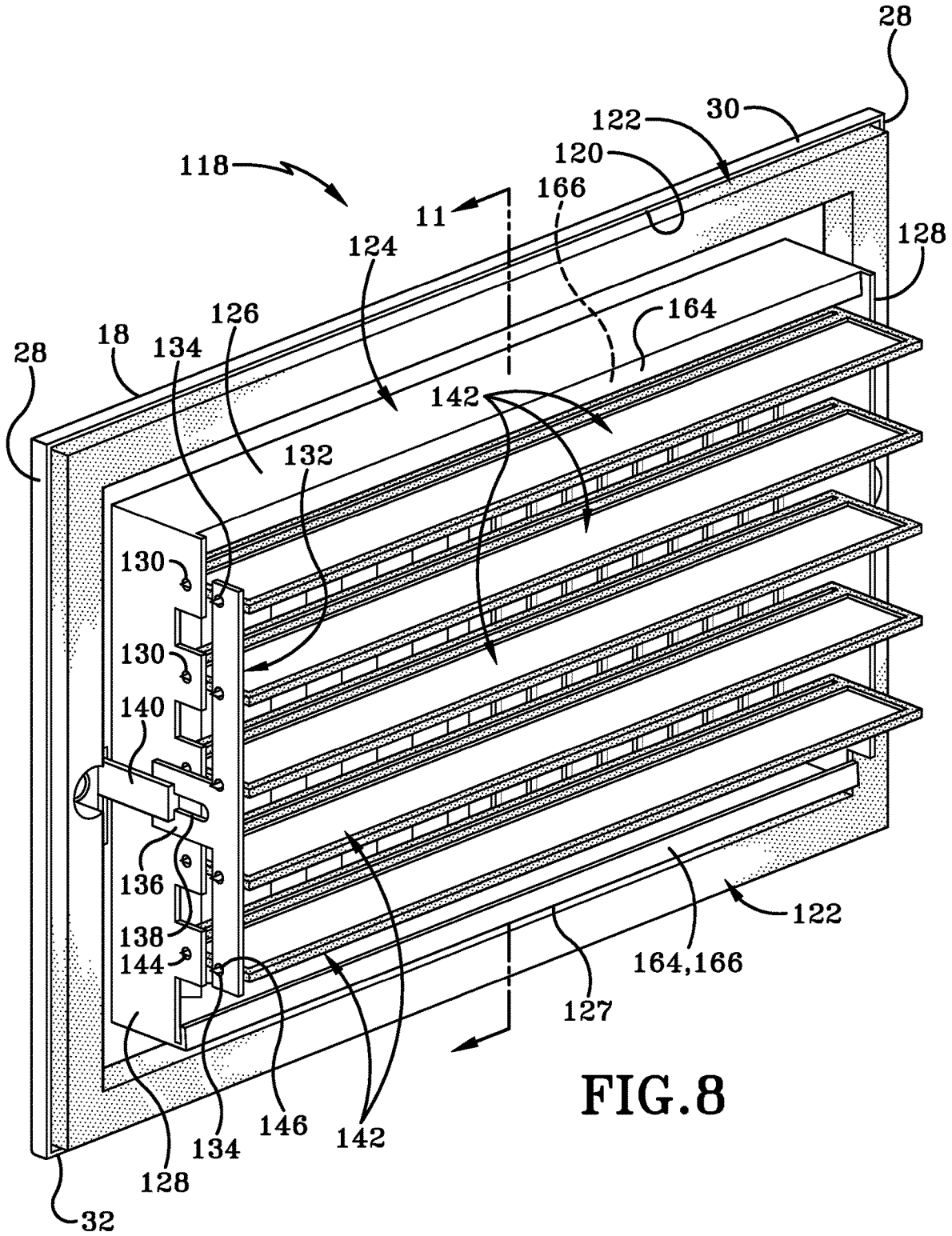
FIG. 8 is a rear perspective view of a second aspect air register with louvers in the open position.
Figure 9:
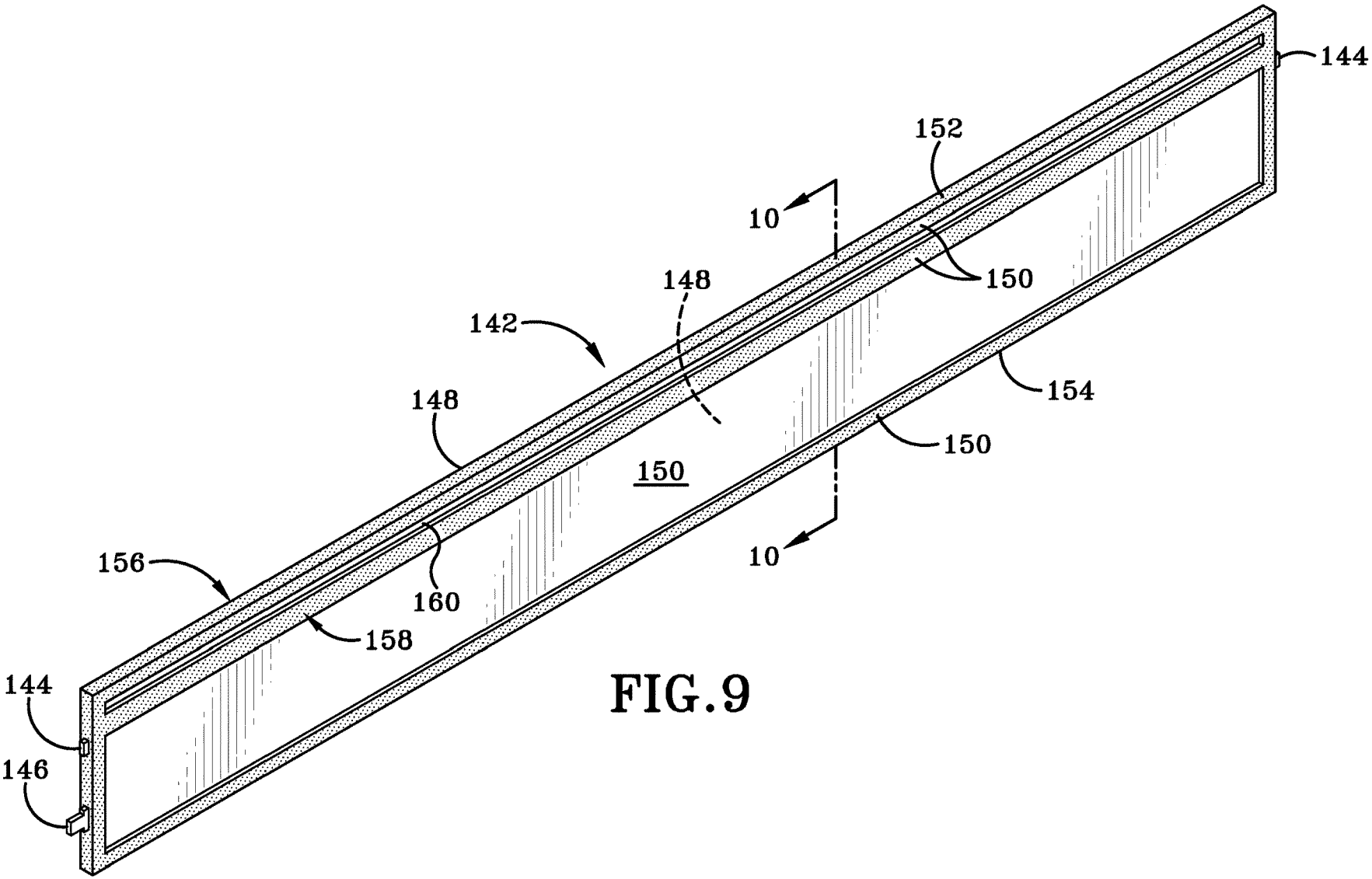
FIG. 9 is a perspective view of a louver removed from the second aspect air register.
Figure 10:
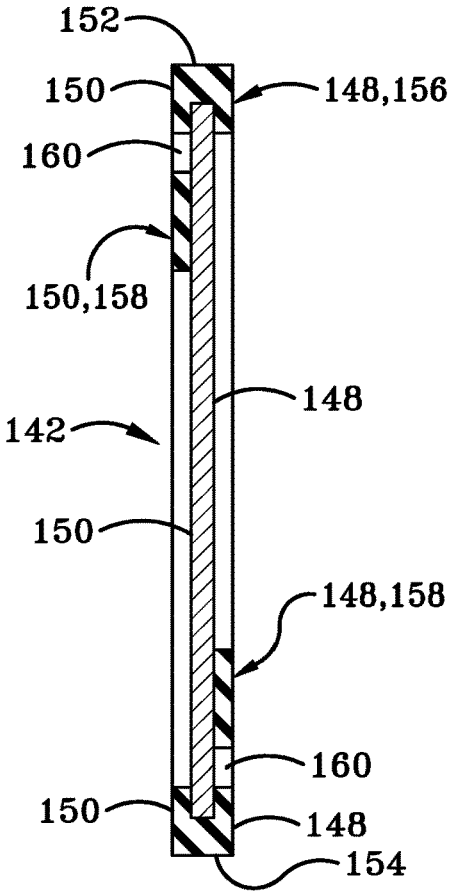
FIG. 10 is a sectional view taken generally about line 10-10 in FIG. 9.

FIG. 7 illustrates the air flow controller wheel 22 rotated in the direction associated with arrow 110 to move the upper air dam 58 and lower air dam 60 to a closed position in the directions associated with arrows 112 and 114. As can be seen, when the upper air dam 58 and lower air dam 60 are in contact with each other at trailing edges 78, 86 or when the trailing edges overlap, air flow 108 hits the outer surfaces 80, 88 and is deflected in the directions associated with arrows 116, thereby preventing air from passing through the air register and into the conditioned space. Further, the air register can also prevent losing conditioned air into the air duct space, thereby providing a more efficient system. Accordingly, a user can selectively open or close the air register by rotating the air flow controller wheel 22 which pivots the air dams open or close as may be needed.

FIGS. 8-13 illustrate various views of a second aspect air register 118 with top wall 30 and sidewalls 28 forming a gasket region 120 for receiving a perimeter gasket 122. A louver assembly 124 extends rearward and includes a louver assembly top wall 126, louver assembly side walls 128, and a louver assembly bottom wall 127. Louver assembly 124 also includes a plurality of assembly holes 130 in the side walls, while a louver actuator mechanism 132 includes mechanism holes 134 therein. A mechanism arm 136 is connected to actuator mechanism 132 and includes a slot 138. Slot 138 operatively receives louver controller 140. A plurality of louvers 142 are positioned at least partially within louver assembly 124 and connected through holes 130, 134 with louver assembly pins 144 and louver actuator mechanism pins 146. The pins 144 and 146 are each positioned on ends of each louver 142 and allow louvers 142 to pivot from an open to a closed position or from a closed position to an open position by moving louver controller 140.

Louvers 142 also include a front surface 148, a rear surface 150, a top surface 152, and a bottom surface 154. A louver perimeter gasket 156 extends around the perimeter and edges of the front and rear surfaces while a secondary gasket portion 158 is separated by a gasket gap 160. The perimeter gasket 156 and secondary gasket portion 158 together function to provide a sealing mechanism between louvers and against the louver assembly. Specifically, sealing walls 164 extends from louver assembly top wall 126 downward and includes a sealing surface 166. Sealing walls 164 may also extend from louver bottom assembly bottom wall 127 and also includes sealing surface 164. In one embodiment, sealing walls 164 are positioned at the top and bottom of the louver assembly and may be the same or different from top wall 126. Further, sealing surface 166 may be straight or angled with respect to louver assembly top wall 126 and louver assembly bottom wall 127 and may include a gasket formed directly on sealing surface 166 or may be adapted to contact a perimeter gasket 156 of the louvers.

Figure 11:
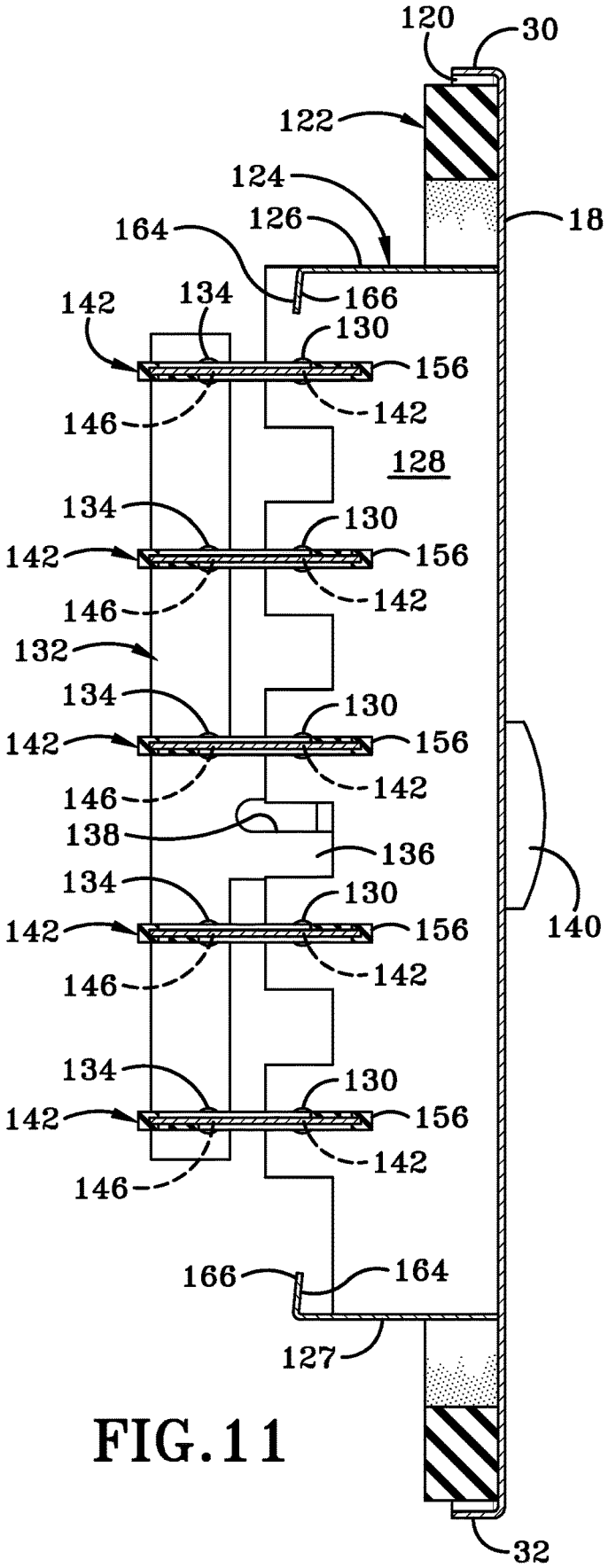
FIG. 11 is a sectional view taken generally about line 11-11 in FIG. 8.
Figure 12:
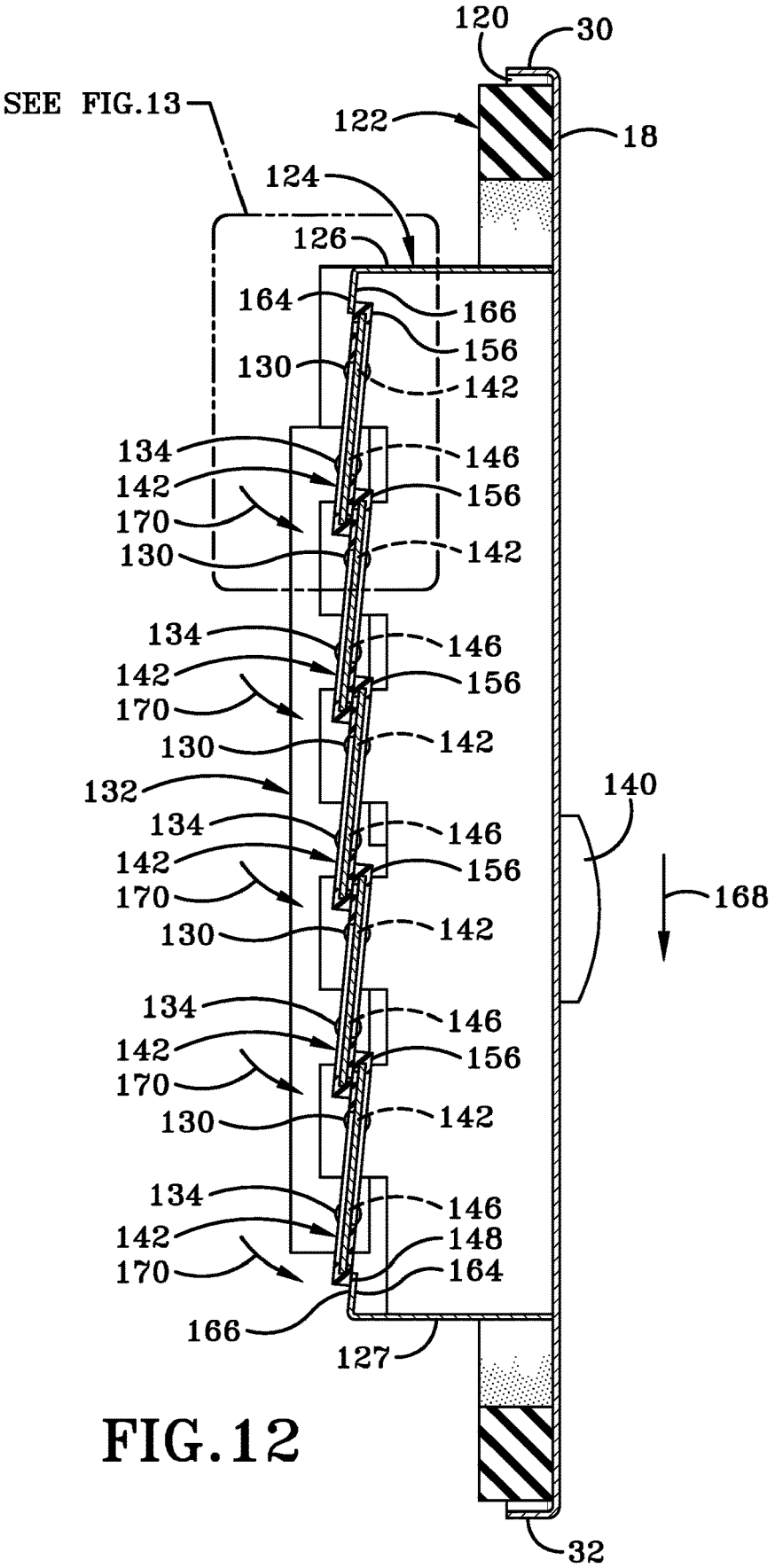
FIG. 12 is a sectional view taken generally about line 11-11 in FIG. 8 but now in the closed position.
Figure 13:
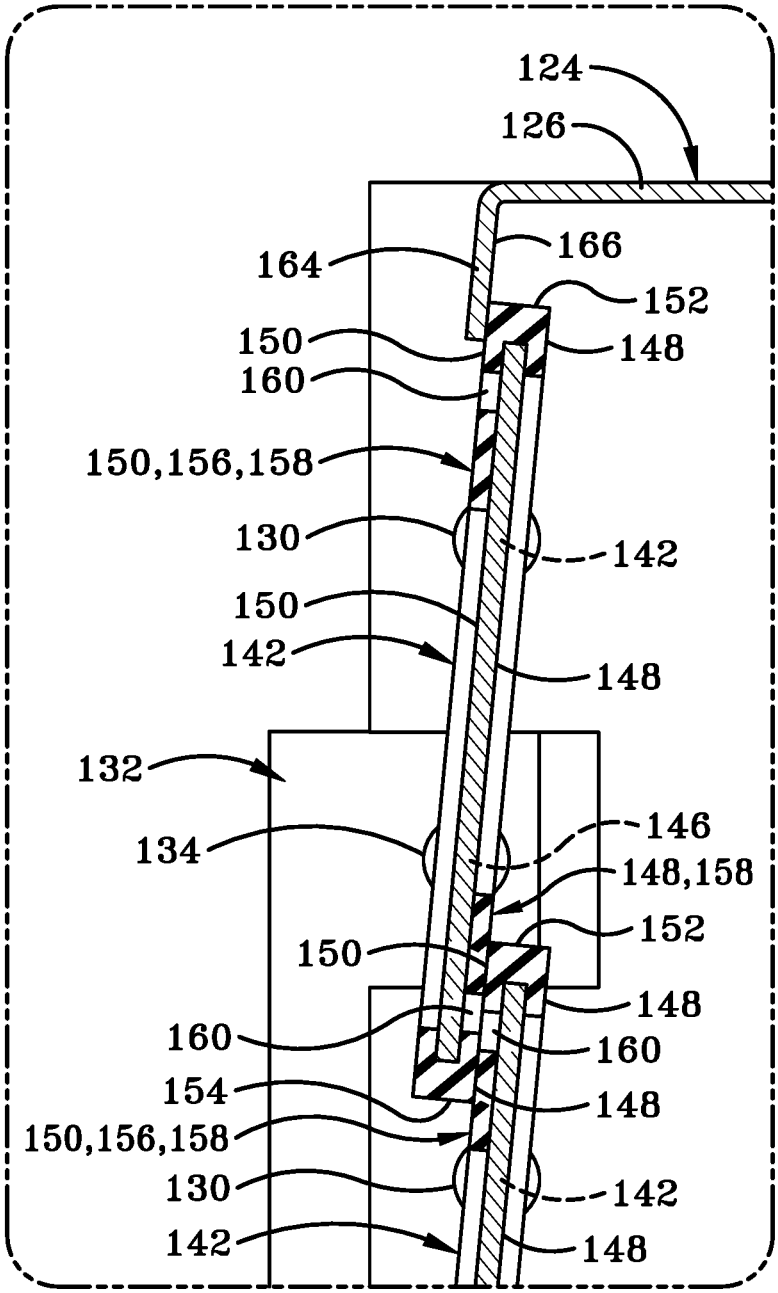
FIG. 13 is an enlarged view of the region labeled FIG. 13 in FIG. 12.
Figure 14:
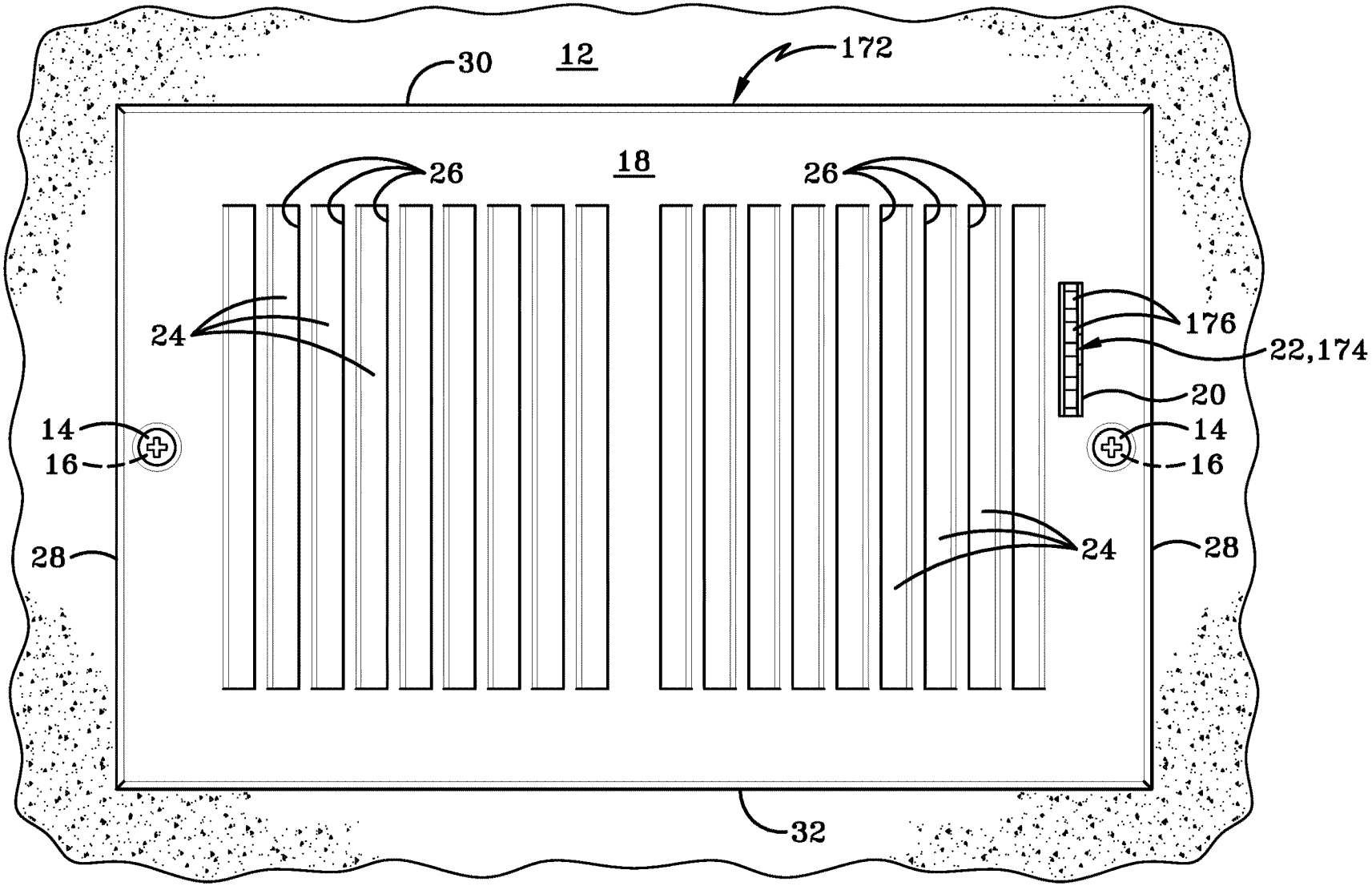
FIG. 14 is a front view of a third aspect air register mounted to a wall.
Figure 15:
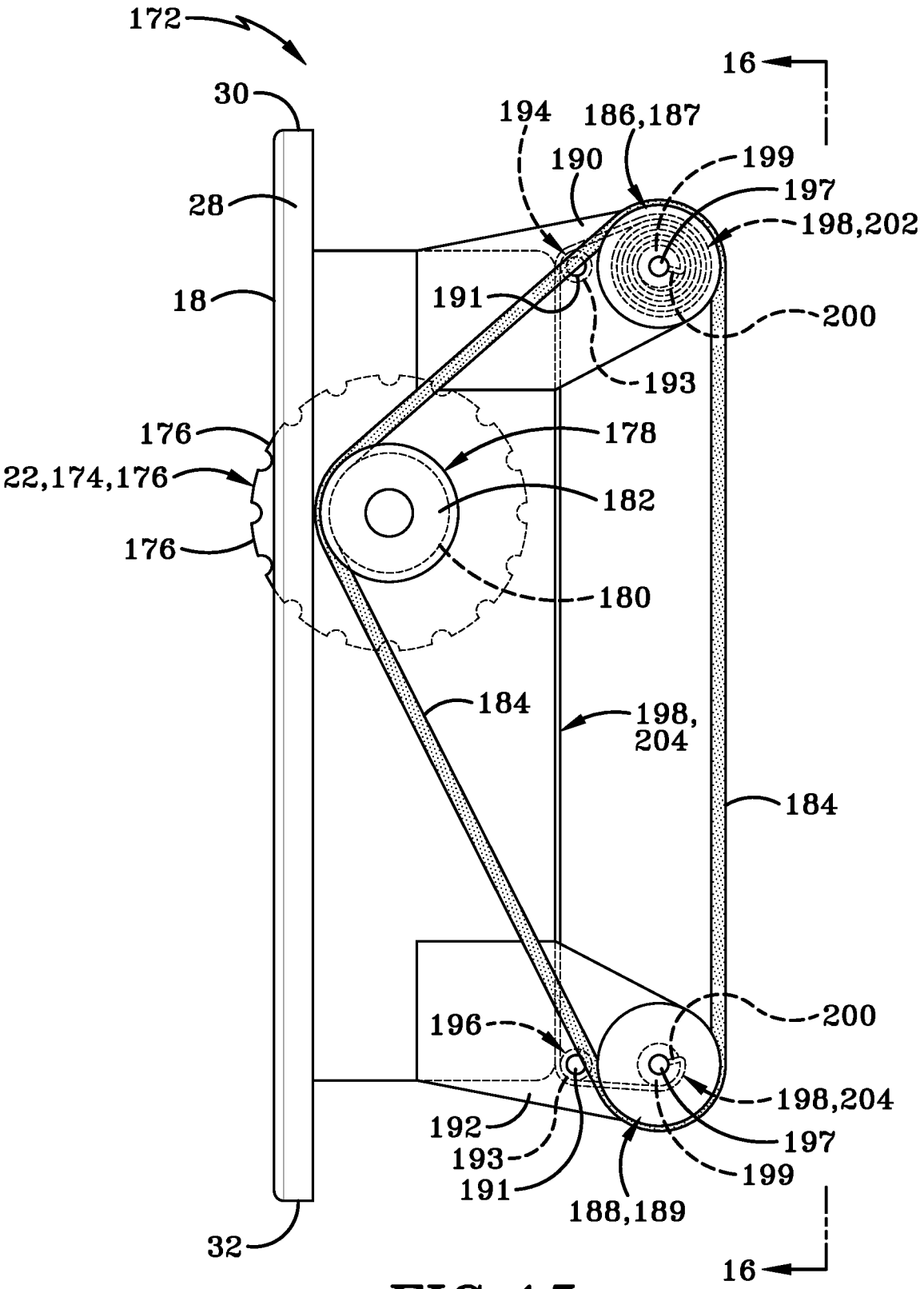
FIG. 15 is a right side view of the third aspect air register with the pulley system visible.

FIG. 11 illustrates the air register 118 with the louvers 142 in the fully open position such that the full volume of air flow may pass through with little interruption. FIGS. 12 and 13 illustrates the movement associated with closing the air register by moving louver controller 140 down in the direction associated with arrow 168, which pivots louvers 142 in the direction associated with arrows 170 until louver perimeter gaskets 156 and secondary gasket portions 158 contact each other to provide a sealing force and engagement with each other and/or sealing surface 166. As can be seen, air is thereby prevented from entering or leaving the air register due to the sealing mechanism on the louvers and thereby reduces leakage into the air duct or into the conditioned space and is therefore more energy efficient.

FIGS. 14-18 illustrate various views of a third aspect air register 172 having a controller wheel 22 having a perimeter 174 with ridges 176 thereon and controller wheel 22 is rotatable to open or close an air deflector as will be described in greater detail below. Controller wheel 22 in this embodiment also includes a drive pulley 178 formed as part of the controller wheel and includes a pulley surface 180 and pulley walls 182 for preventing a drive belt 184 from walking or slipping off the pulley. Drive belt 184 is connected to a first pulley assembly 186 having a pulley 187 and a second pulley 188 assembly having a pulley 189 which all together define the drive system for opening or closing the air deflector. First pulley assembly 186 is mounted on a pulley mount 190 extending approximately across the width of the air register, while second pulley assembly 188 is mounted on a pulley mount 192 which also extends approximately across the width of the air register. The air deflector system also includes air deflector pulleys 194 and 196 each having a rod 191 and a sleeve 193 with either, or both, of the rod and the sleeve rotatable with the air deflector and which functions to provide a linear distance there between which is directly in front of the air register flow path.

Figure 16:
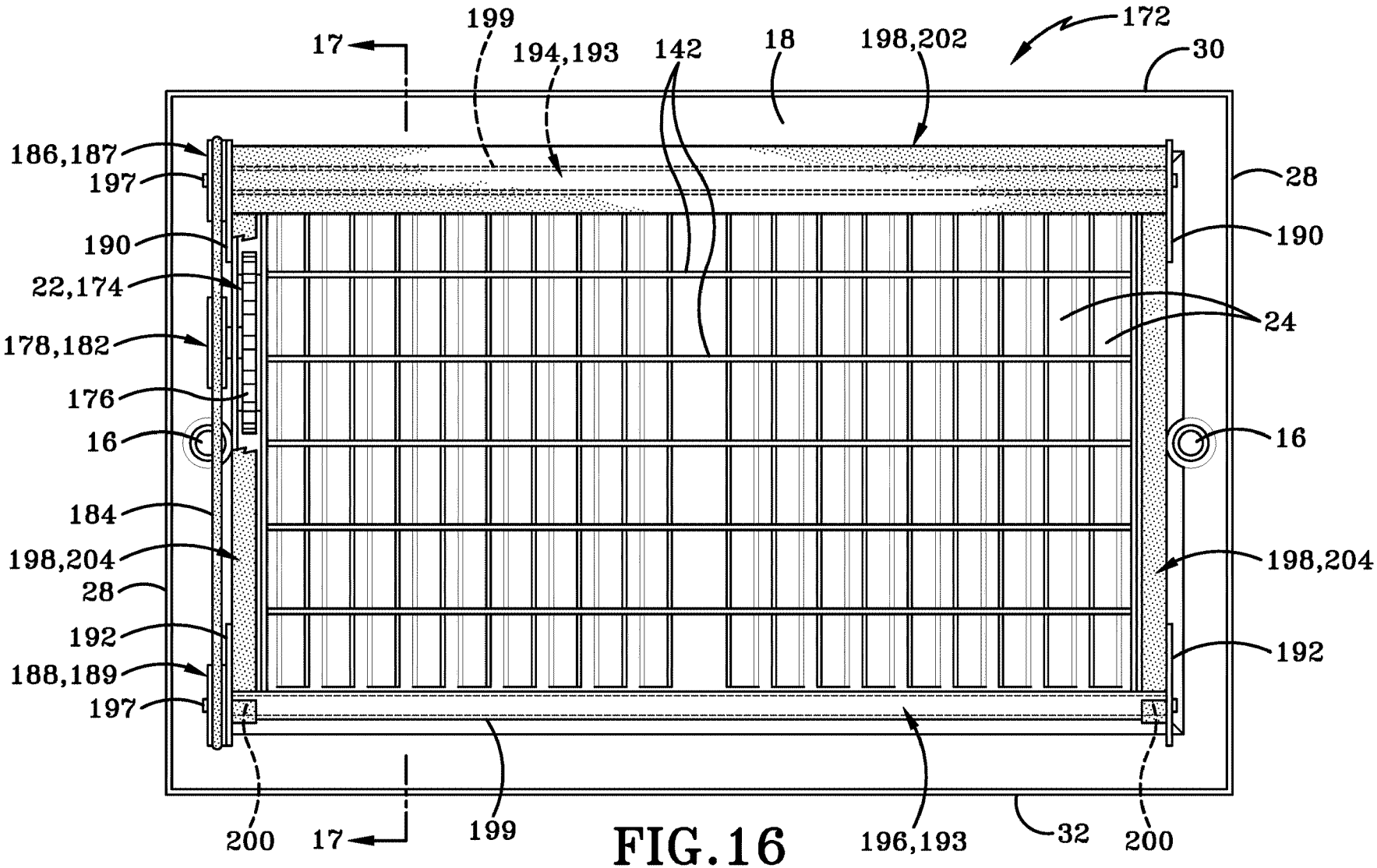
FIG. 16 is a rear view of the third aspect air register in the open position.

An air deflector 198 connects to first and second pulley assemblies 186, 188 at notches 200 on the respective pulleys with an air deflector pin 197 secured within notches 200 of a sleeve 199. In this instance, sleeve 199 and notches 200 may rotate around air deflector pin 197 to allow the air deflector to unroll or roll up depending on the pulley assembly. Referring to FIG. 16, air deflector 198 is shown including a main body 202 and a pulley attachment portion 204. Specifically, the air defector pulley attachment portion 204 is connected to the second pulley assembly 188 and when the air deflector is actuated to block airflow through the air register, the attachment portion 204 is wrapped around the second pulley assembly 188 until the main body 202 of the air deflector blocks the entire air register opening. The drive belt and drive system function to roll and unroll the air deflector by simply rotating controller wheel 22.

Figure 17:
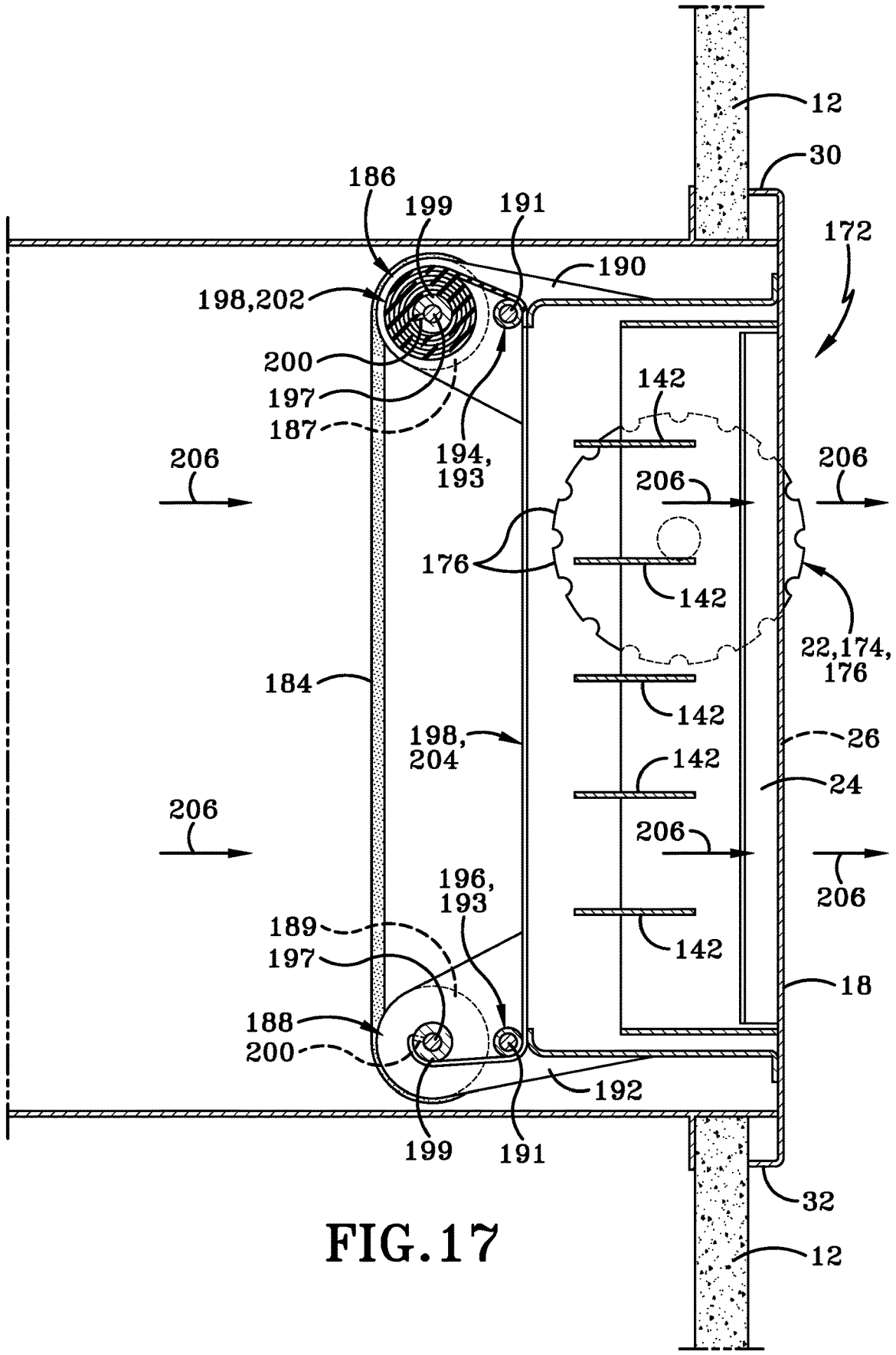
FIG. 17 is a sectional view taken generally about line 17-17 in FIG. 16.
Figure 18:
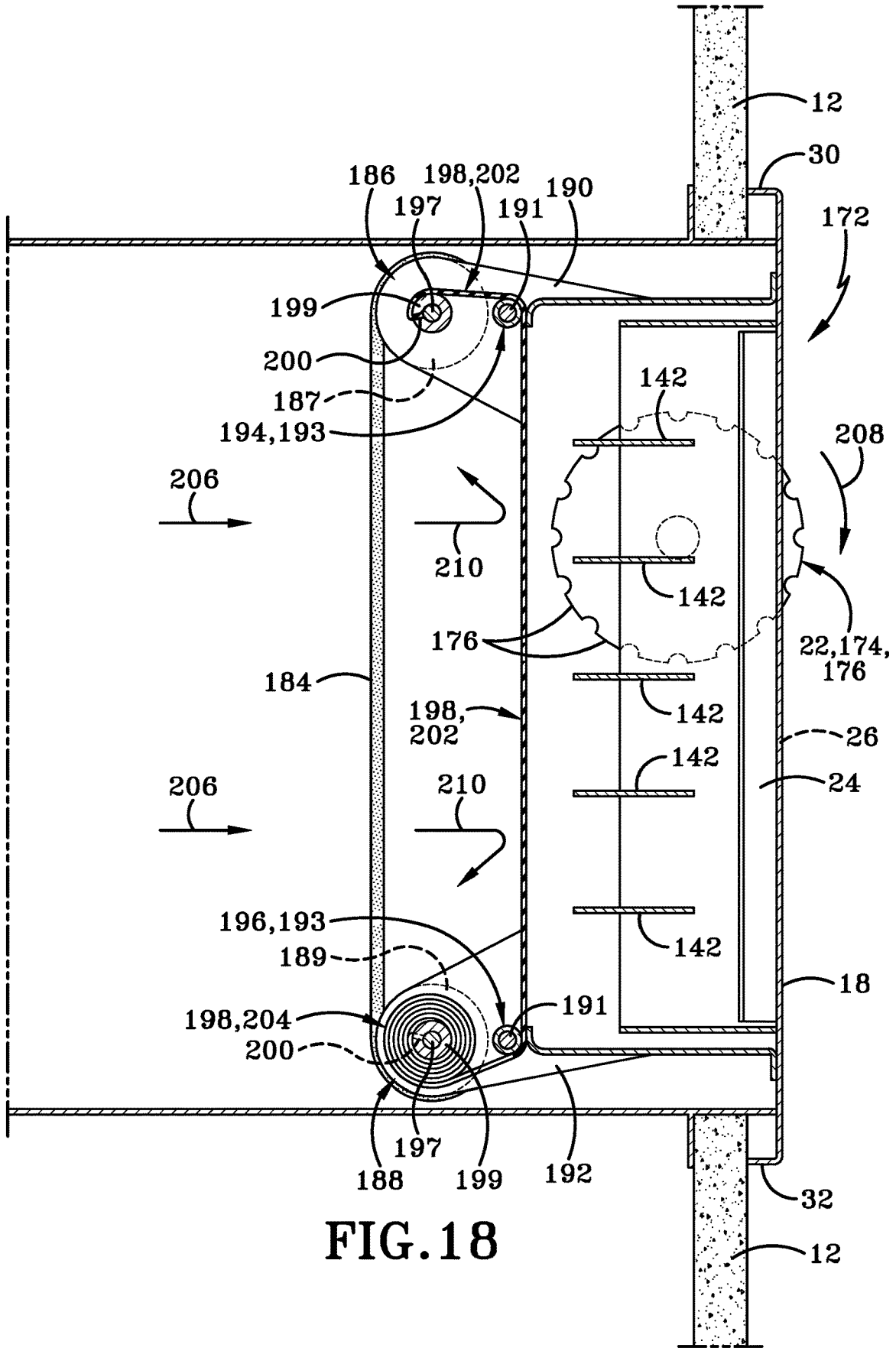
FIG. 18 is a sectional view taken generally about line 17-17 in FIG. 16 but now in the closed position.
Figure 19:
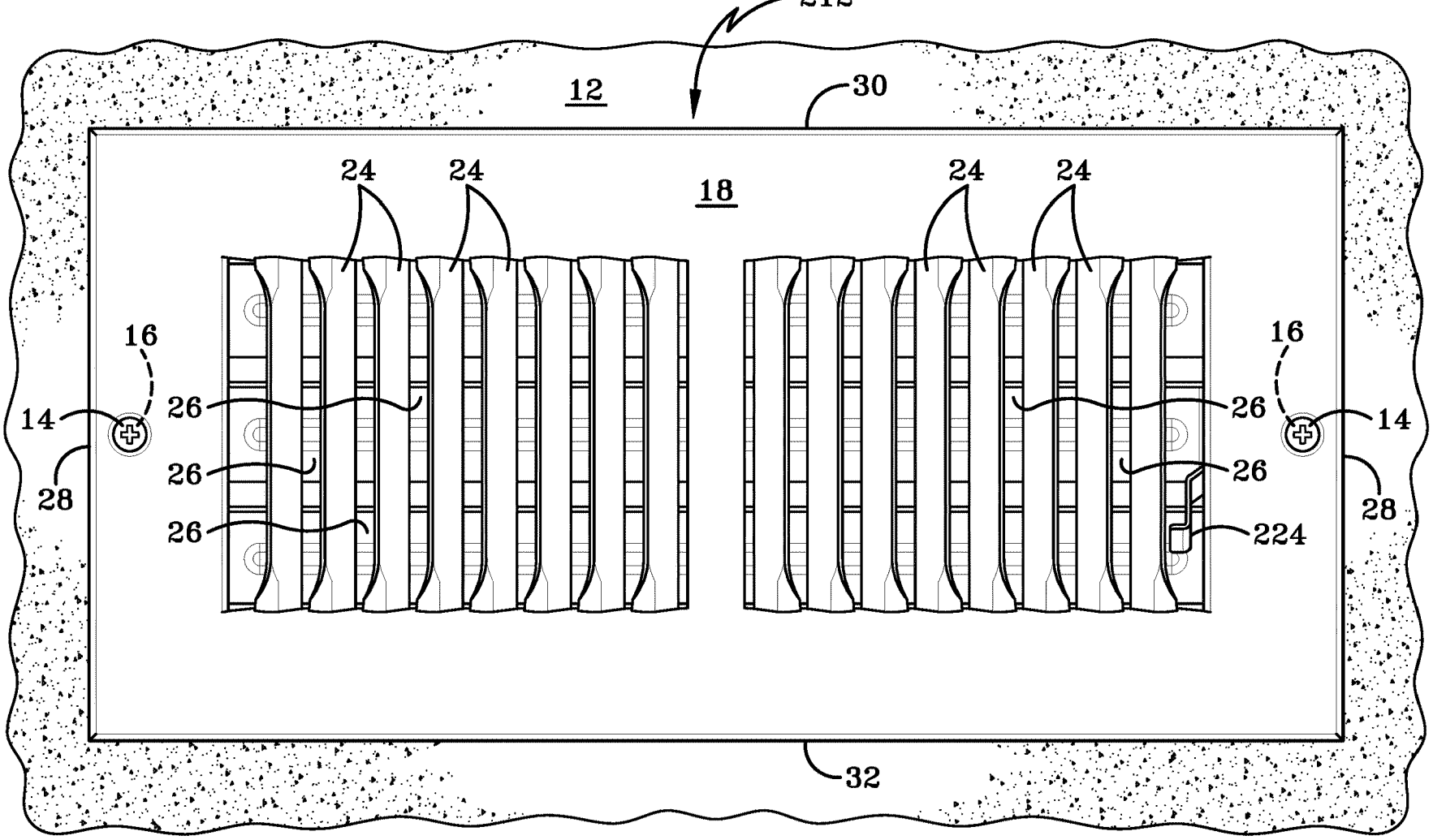
FIG. 19 is a front view of a fourth aspect air register mounted to a wall.
Figure 20:
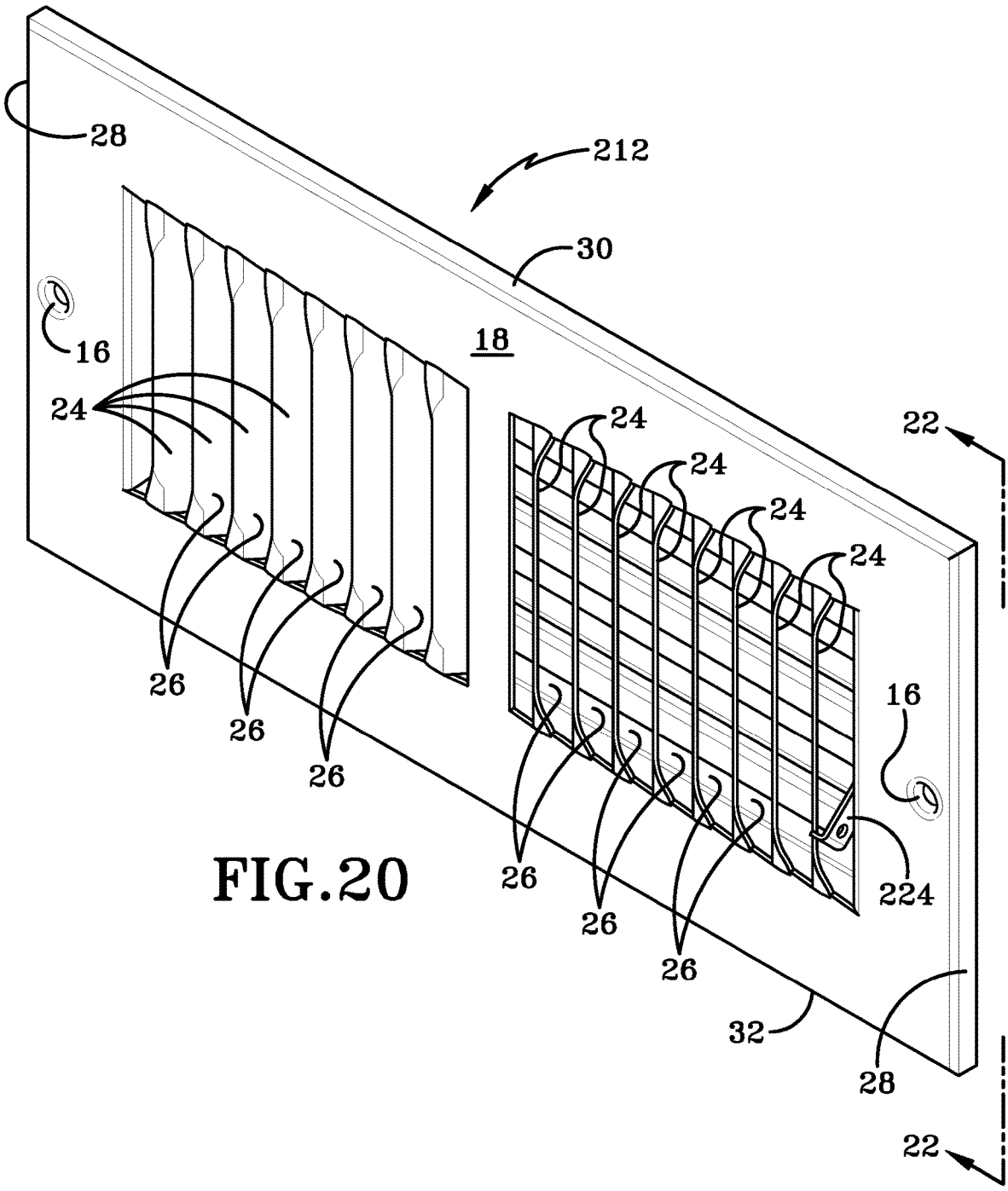
FIG. 20 is a perspective view of the fourth aspect air register.
Figure 21:
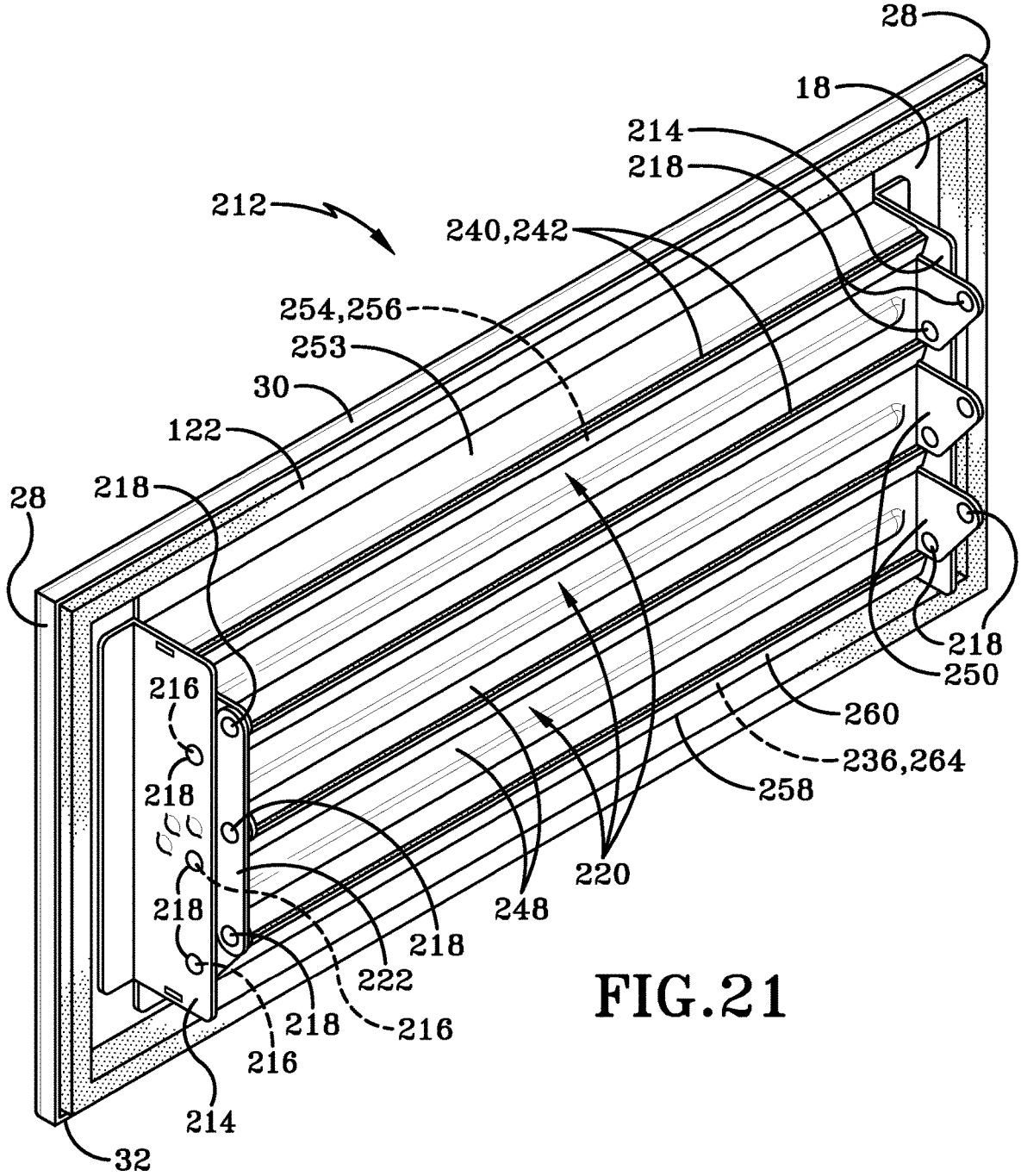
FIG. 21 is a rear perspective view of the fourth aspect air register.

FIG. 17 illustrates the air register in the fully open position with the main body 202 of air deflector 198 retracted from the flow path and air flow 206 is not restricted from passing through air register 172 and by louvers 142. FIG. 18 illustrates the air register controller wheel rotated in the direction associated with arrow 208 to lower main body 202 of air deflector 198. When air deflector 198 is lowered, air 206 contacts the air deflector and is blocked as shown by arrows 210. In this manner, it is seen that the air deflector 198 may efficiently and easily block airflow through the air register when desired and allow full air flow as needed. The air deflector may be any suitable material and structure. Non-limiting examples include rubber, vinyl, plastic, sheet metal, aluminum, or any other number of numerous rigid or flexible materials.

Figure 27:
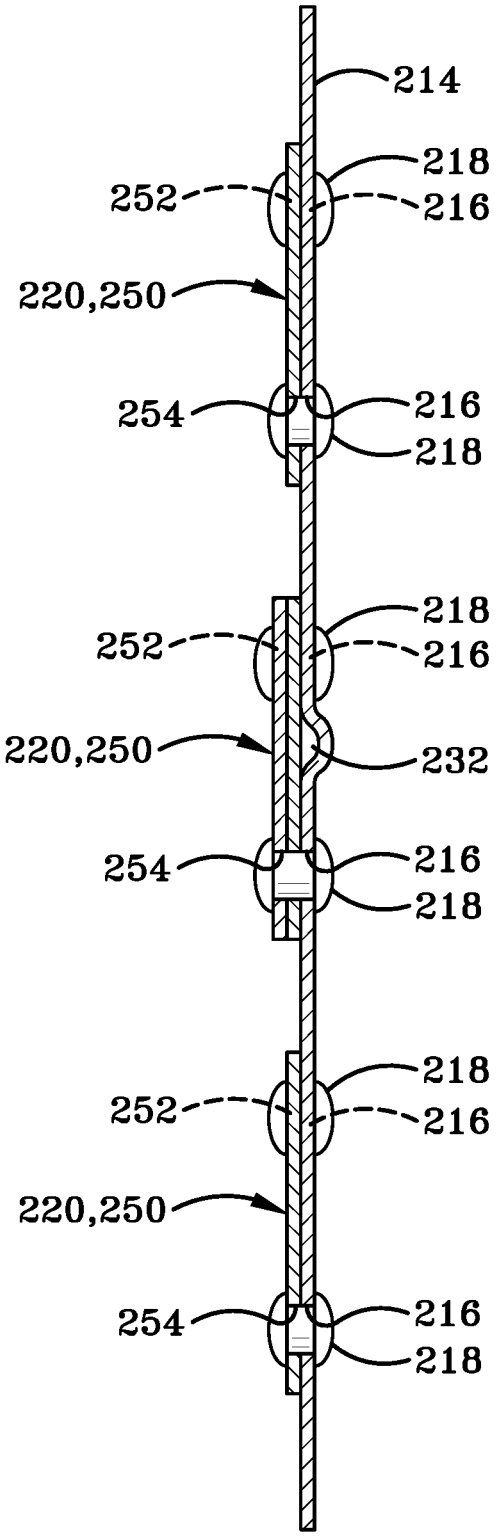
FIG. 27 is a sectional view taken generally about line 27-27 in FIG. 25.
Figure 28:
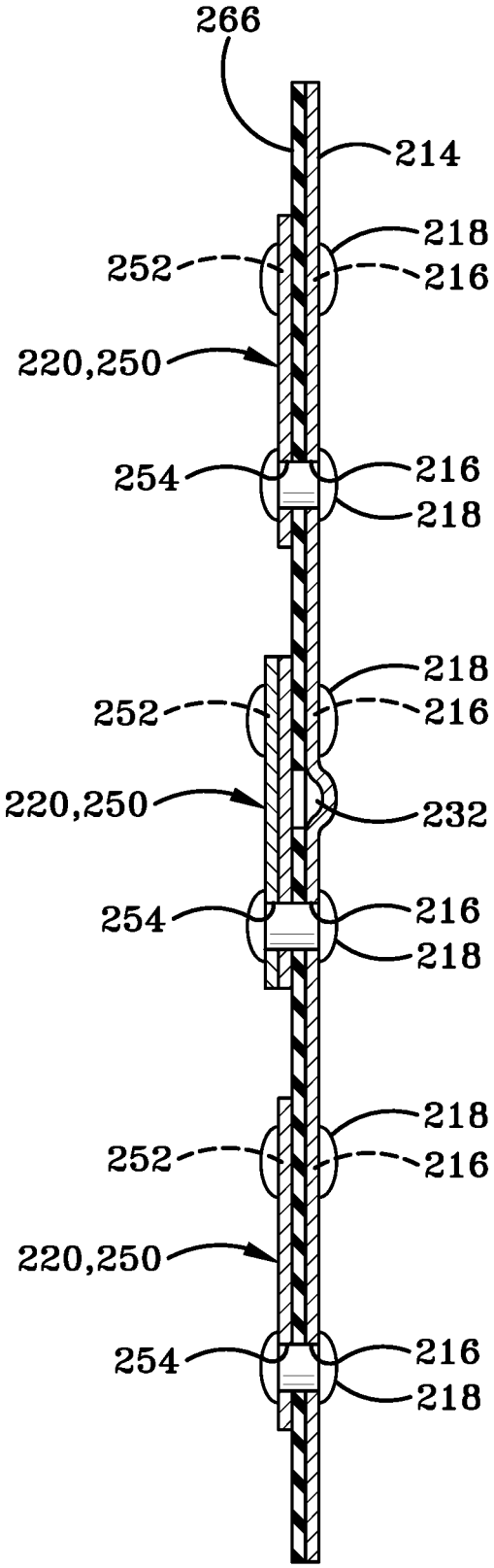
FIG. 28 is a sectional view taken generally about line 27-27 in FIG. 25 but now includes a gasket therein.
Figure 29:
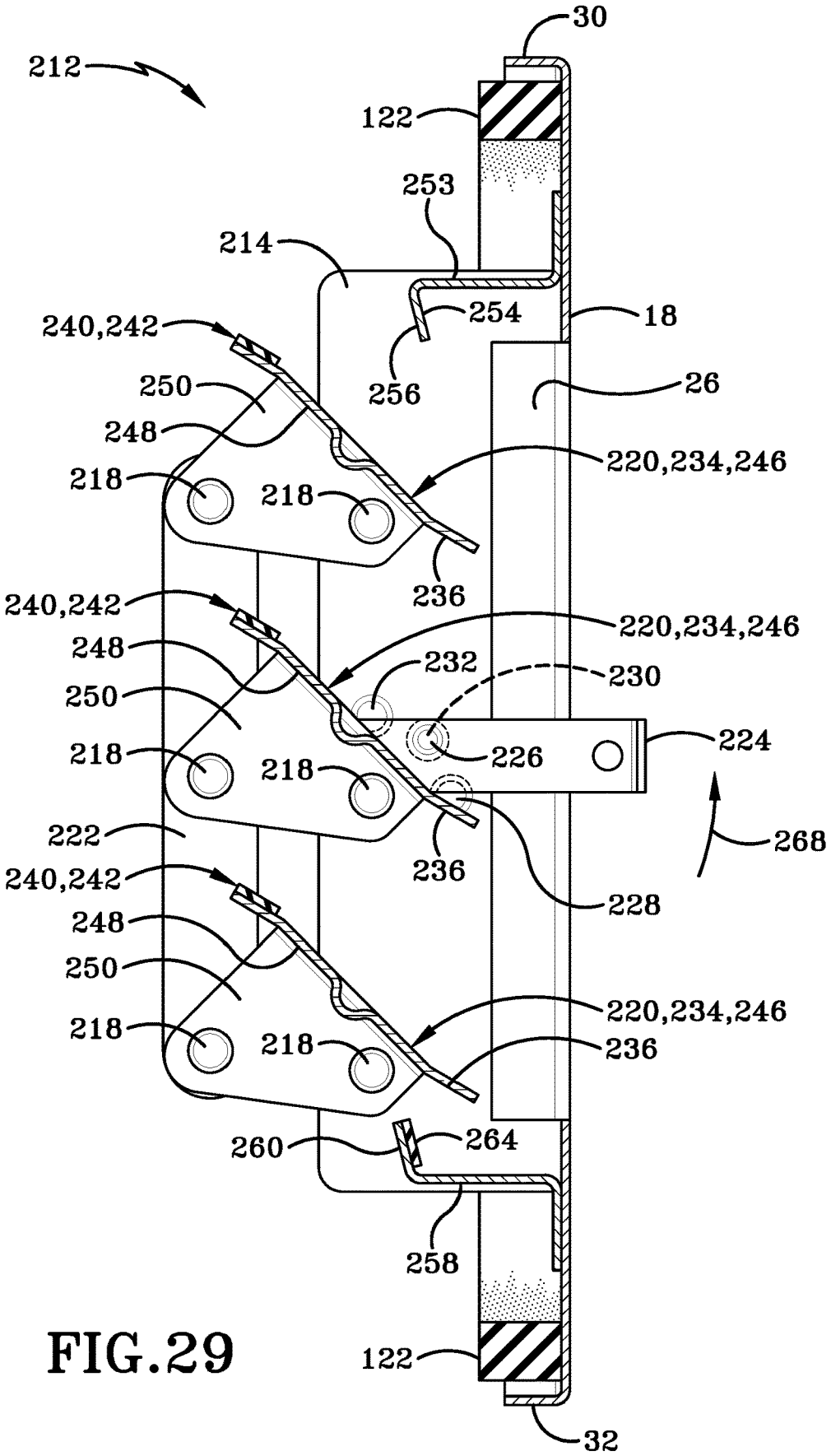
FIG. 29 is a sectional view taken generally about line 25-25 in FIG. 24 with the fourth aspect air register in the partially open position.
Figure 30:
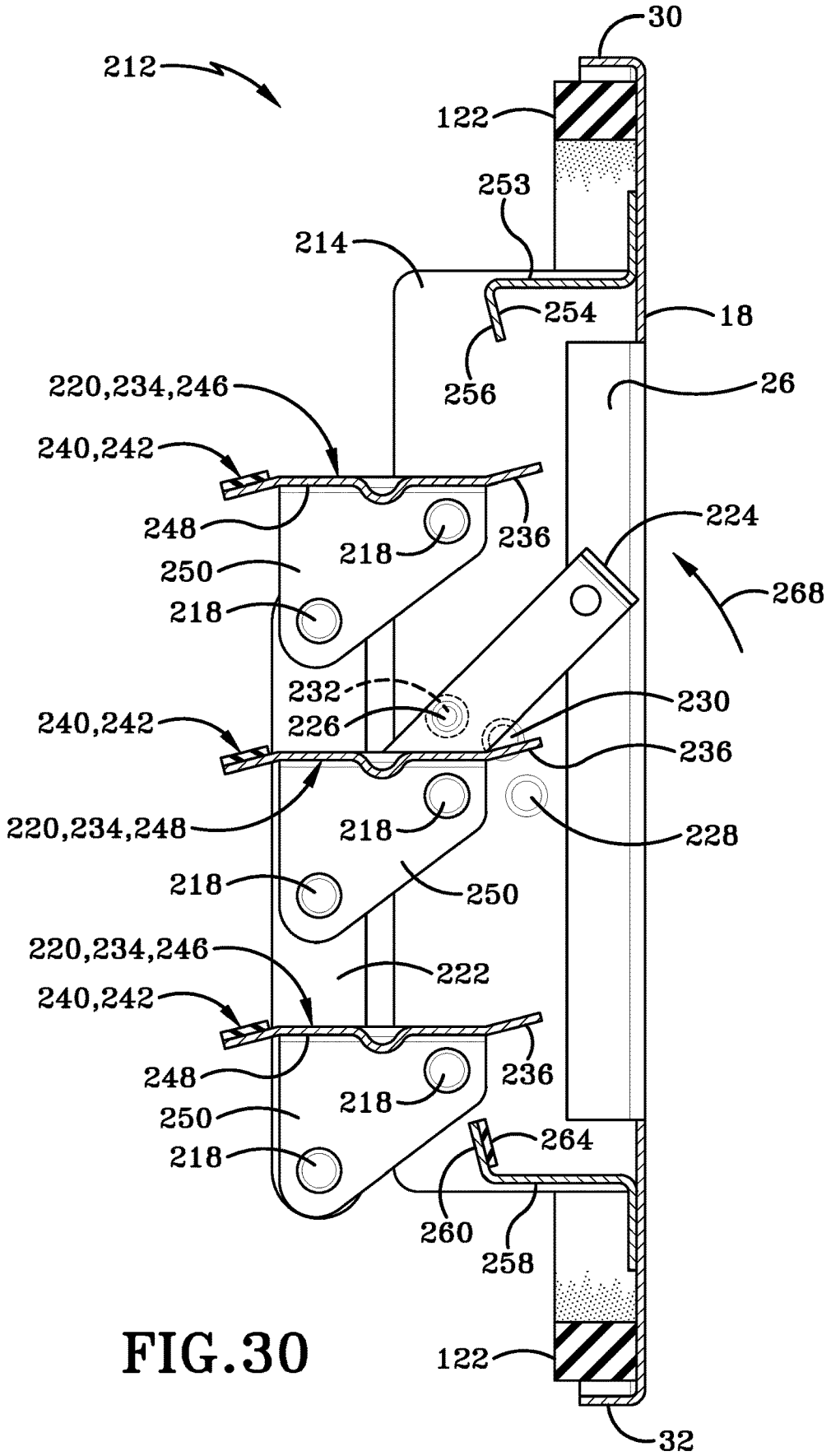
FIG. 30 is a sectional view taken generally about line 25-25 in FIG. 24 with the fourth aspect air register in the fully open position.

FIGS. 19-30 illustrate various views of a fourth aspect air register 212 with vanes 24 and vane slots 26 there between. In this aspect, vanes 24 are shown as fixed, but it is within the spirit and scope of the present disclosure to incorporate moveable, pivotable, or flexible vanes in this aspect and all of aspects disclosed herein. A pair of louver wall mounts 214 extend rearward from front wall 18 and includes three apertures 216 for receiving rivets 218. Rivets 218 are used to connect louvers 220 to louver wall mounts 214 as well as separately connect louvers 220 to pivot mechanism 222 which moves up and down with movement of a louver controller 224. The movement of pivot mechanism 222 provides a moment on louvers 220 which thereby move to the open or closed position as can be seen in FIGS. 29-30 for example.

Figure 22:
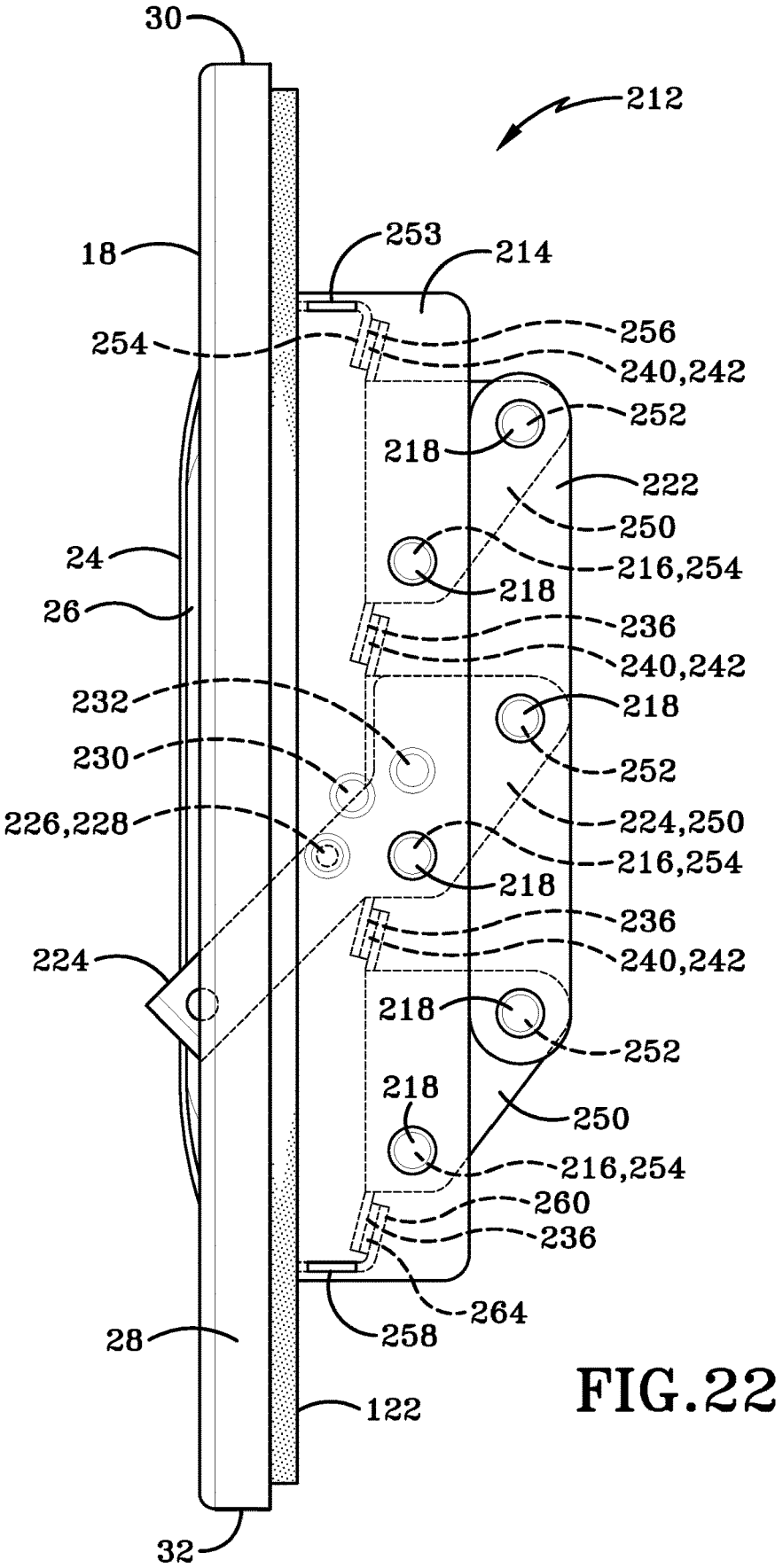
FIG. 22 is a sectional view taken generally about line 22-22 in FIG. 20.

FIG. 22 illustrates a closer view of louver controller 224 with an alignment pin 226 thereon extending generally in the direction of three detents on the air register 212. Specifically, a closed detent 228, a partially open detent 230, and a fully open detent 232 are each positioned on the air register to prevent the flow volume from changing from the desired setting. The alignment pin is oriented to fit within the appropriate detent 228, 230, 232 but not move outside of the appropriate detent until overcome with enough force as can easily be applied by a person, but not applied by the air register alone in normal operation.

Figure 23:
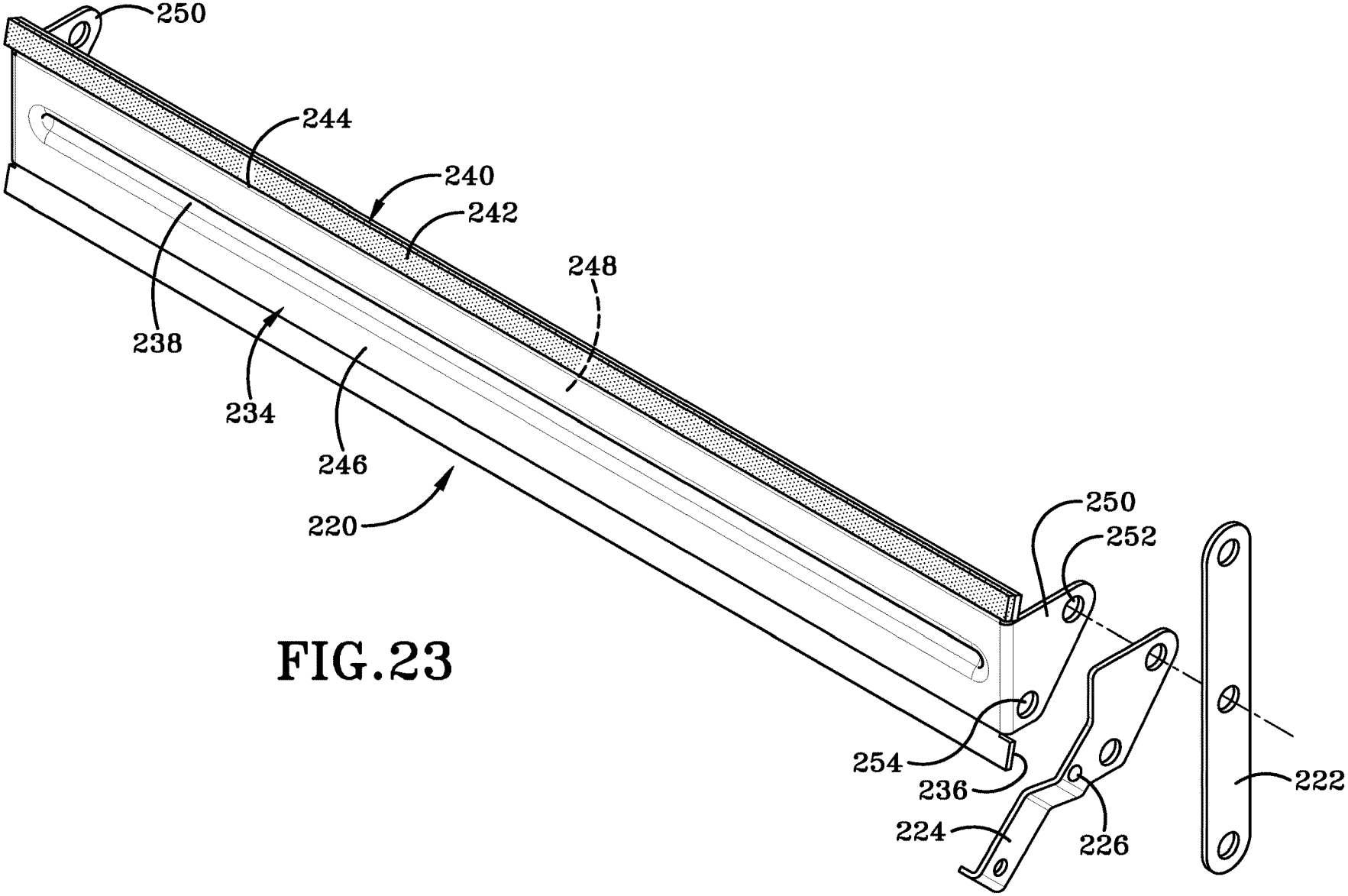
FIG. 23 is a perspective view of a louver of the fourth aspect air register.
Figure 24:
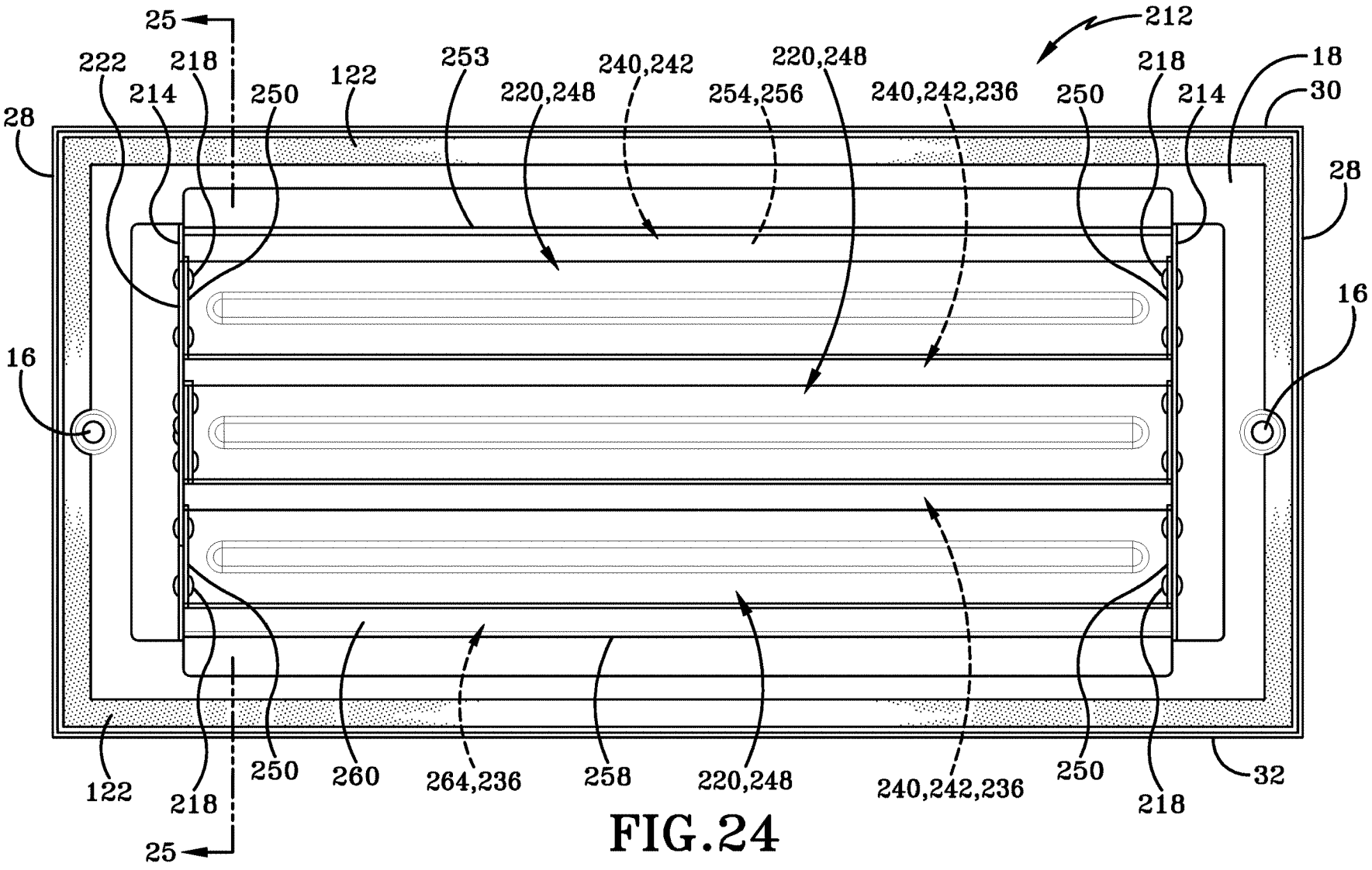
FIG. 24 is a rear view of the fourth aspect air register.

FIG. 23 illustrates a louver 220 removed from air register 212. Each louver 220 includes a body 234 having a sealing region 236, a recessed portion 238 in the center, and a gasket region 240. Gasket region 240 may include a gasket 242 along the length and extends above a top surface 244 of the front surface 246 and rear surface 248. Sealing region 236 and gasket region 240 may be angled with respect to body 234 to better assist with sealing or may be aligned along the same plane. Still further, it is within the spirit and scope of the present disclosure to reverse the positioning of the gasket portion and the sealing portion such that the sealing portion may be at the top and the gasket portion at the bottom.

Each louver 220 also includes arms 250 each having a pivot mechanism alignment hole 252 and a pivot hole 254 upon which each louver may pivot. The pivot mechanism alignment hole 252 allows all the louvers to be physically connected and move as a single unit through being offset from pivot hole 254 and the movement of pivot mechanism 222.

Figure 25:
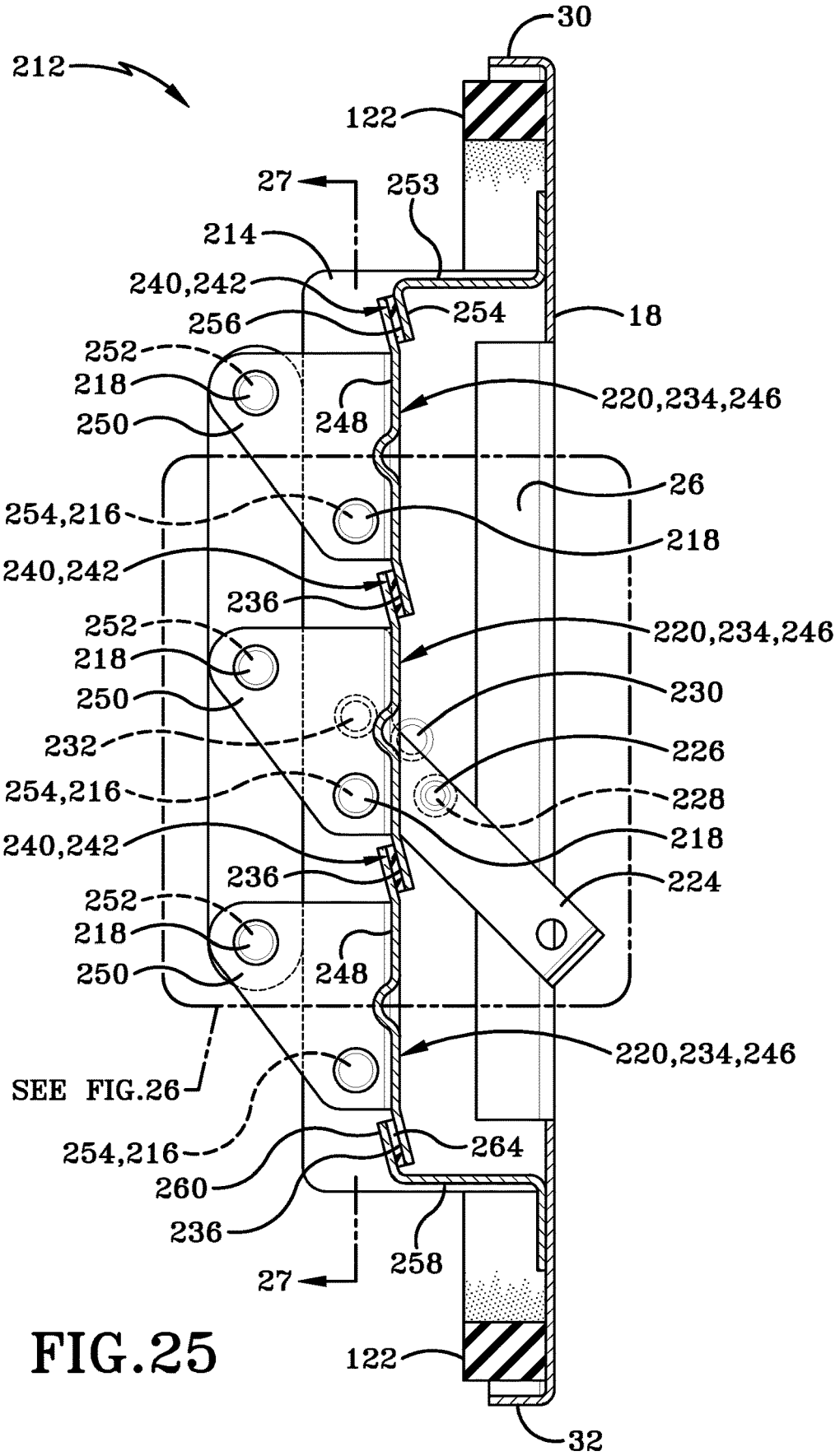
FIG. 25 is a sectional view taken generally about line 25-25 in FIG. 24.
Figure 26:
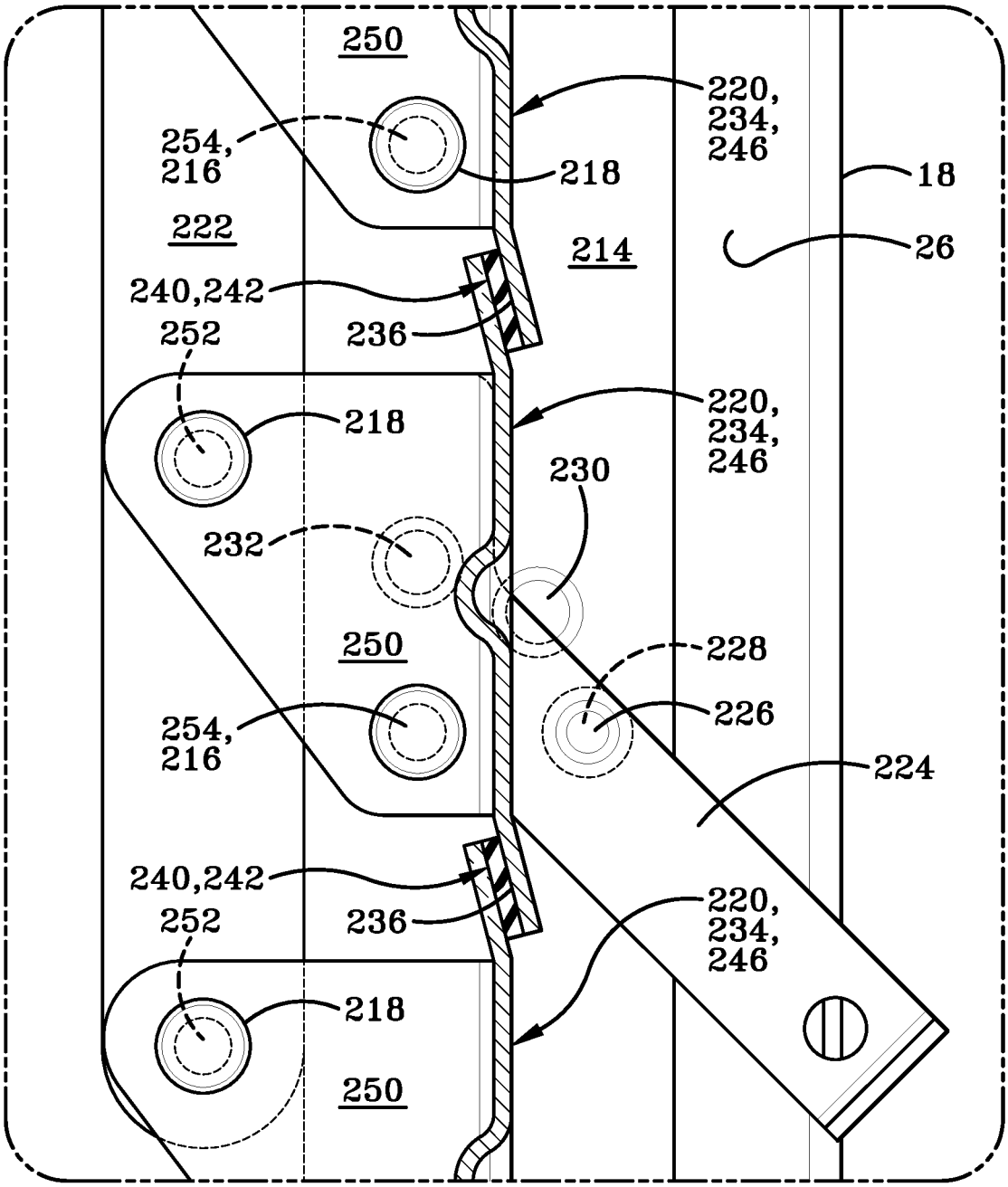
FIG. 26 is an enlarged view of the section labeled FIG. 26 in FIG. 25.

FIGS. 25 and 26 illustrate views of the air register 212 in the fully closed position with gaskets 242 contacting sealing regions 236 to prevent air from passing through the air register 212 in either direction. Further, a top rear wall 253 extends rearward from front wall 18 and includes a wall 254 having a sealing surface 256 for contact with louver gasket 242. Similarly, a lower rear wall 258 extends rearward from front wall 18 and includes a wall 260 having a gasket region 262 having a gasket 264 for contact with louver sealing region 236. As can be seen, the top louver 220 contacts top rear wall 252 and the second louver, while the second louver contacts the first louver and the third louver, and the third louver contacts the second louver and lower rear wall 258 and the four gasket seals between the various components prevents air from entering into the air register from the air duct work or from the conditioned room, thereby providing a more energy efficient solution.

FIGS. 27 and 28 illustrate sectional views of the sidewall with (FIG. 28) and without (FIG. 27) a gasket 266. Gasket 266 is strategically positioned to prevent or at least reduce airflow between the sides of the louvers 220 and the air register body, namely louver wall mounts 214. In particular, arms 250 of the louvers and louver wall mounts 214 may contact gasket 266 in both the open and closed positions to prevent unwanted air from passing though openings there between as well as directing air more efficiently through the louvers 220 and air register vanes. Gasket 266 may be composed of a rubber, foam, flexible plastic or any other suitable material.

FIG. 29 illustrates movement of louver controller 222 in the direction associated with arrow 268 which imparts a rotational movement in each of louvers 220 due to pivot mechanism 222 and the pivot mechanism's connection with each of the louvers 220 at a position offset from the apertures 216 in the louver wall mount. This offset distance allows the force applied to operate a moment which pivots the louvers open. FIG. 29 shows the air register 212 moved to the partially open position with the alignment pin 226 in the partially open detent 230 and louvers 220 roughly 45 degrees from the fully closed position. FIG. 30 shows additional movement until alignment pin 226 is in the fully open detent 232 and the louvers are positioned roughly 90 degrees from the fully closed position to allow full air flow through air register 212. Accordingly, the gaskets on the louvers provide efficient sealing of the air register from the conditioned environment and allow the air register to prevent loss of energy without changing the structural integrity of the air register or the structure that most consumers currently understand. A consumer can easily orient an air register of this disclosure to prevent air flow or allow air flow to pass through as desired. Finally, the gaskets provide a relatively minor impact to the operation of the air register and as such do not significantly decrease air flow through the air register when the louvers are open.

Figure 31:
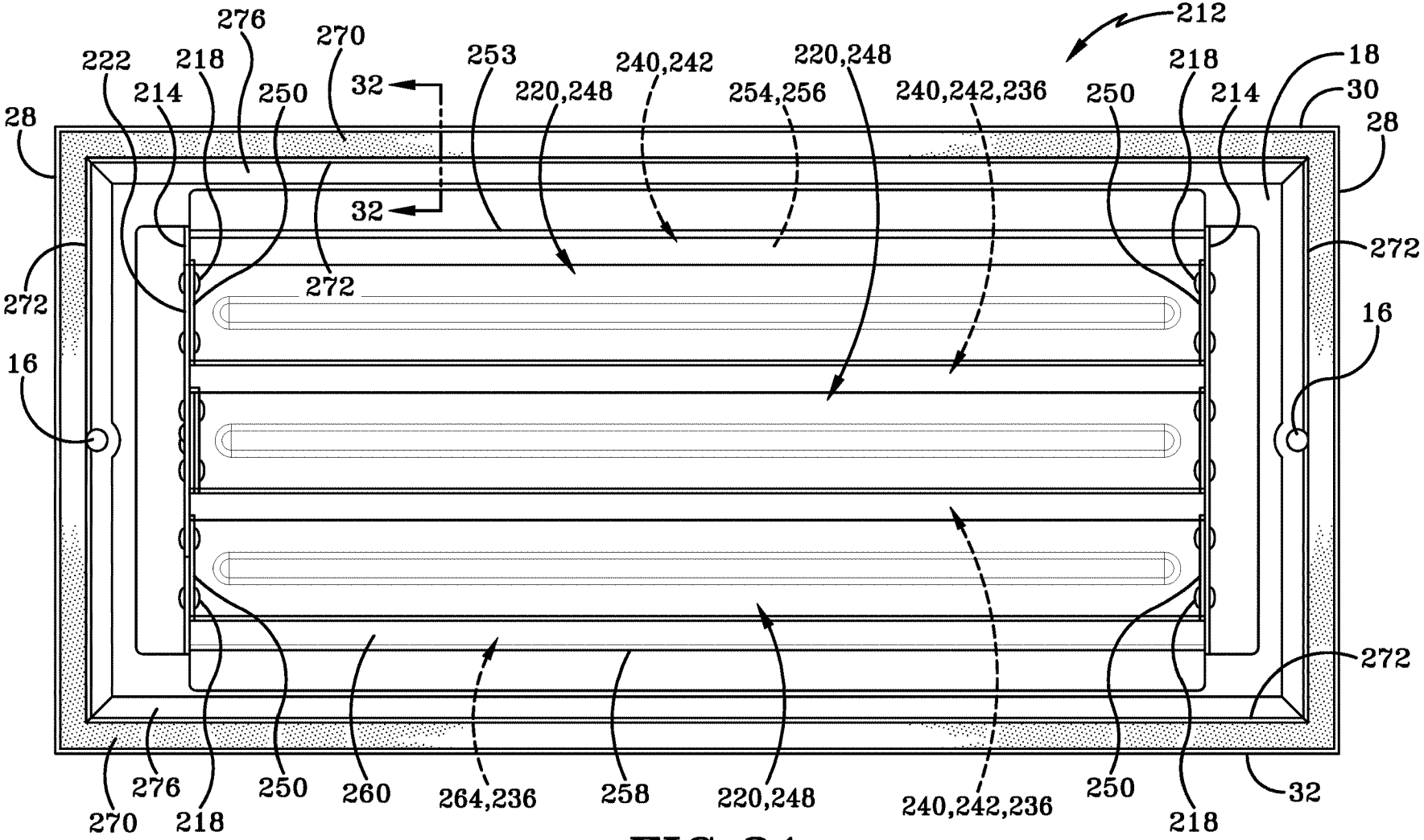
FIG. 31 is a rear view of the fourth aspect air register with a different perimeter gasket.
Figure 32:
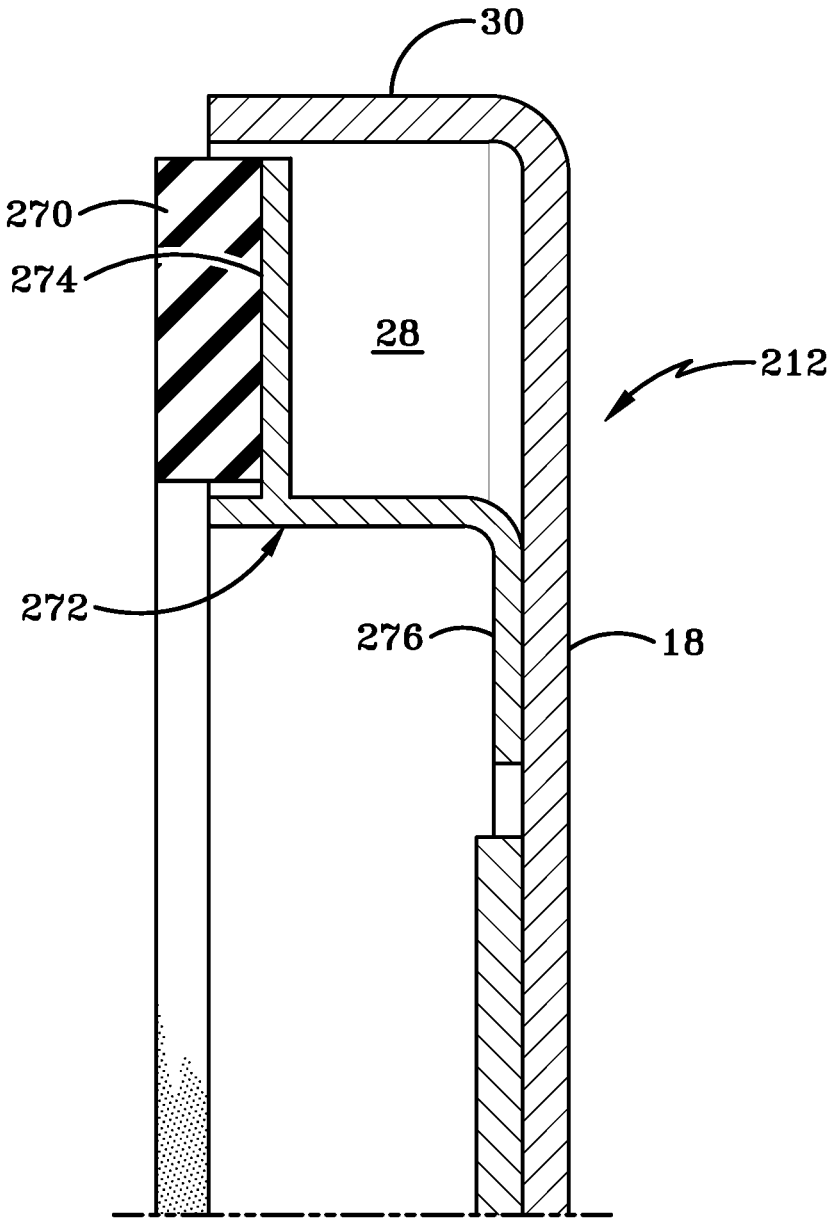
FIG. 32 is a sectional view taken generally about lines 32-32 in FIG. 31.

FIGS. 31 and 32 illustrate an air register 212 with a perimeter gasket 270 positioned between sidewalls 28/top wall 30/bottom wall 32 and gasket wall 272. Gasket wall 272 may also include a gasket mounting surface 274 which is generally perpendicular to sidewalls 28/top wall 30/bottom wall 32 and is connected to front wall 18 of air register 212 at a mounting portion 276. In this arrangement, perimeter gasket 270 may be smaller and is more closely placed in a rearward position with sidewalls 28/top wall 30/bottom wall 32 and gasket wall 272 providing support during installation and mounting to prevent tearing the gasket, thereby providing additional sealing for the air register.

Figure 33:
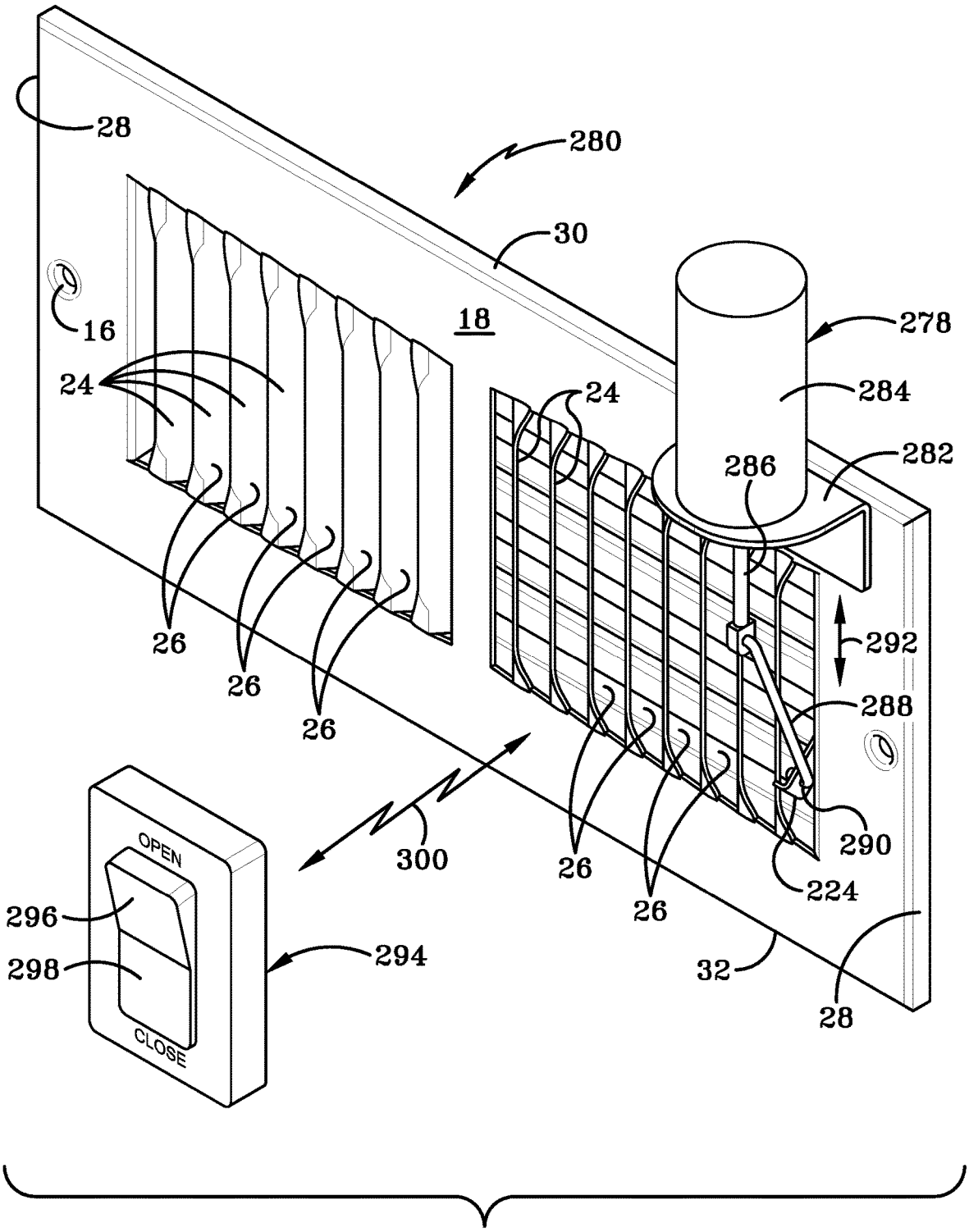
FIG. 33 is an automated air register system with an external louver actuator and a controller.
Figure 34:
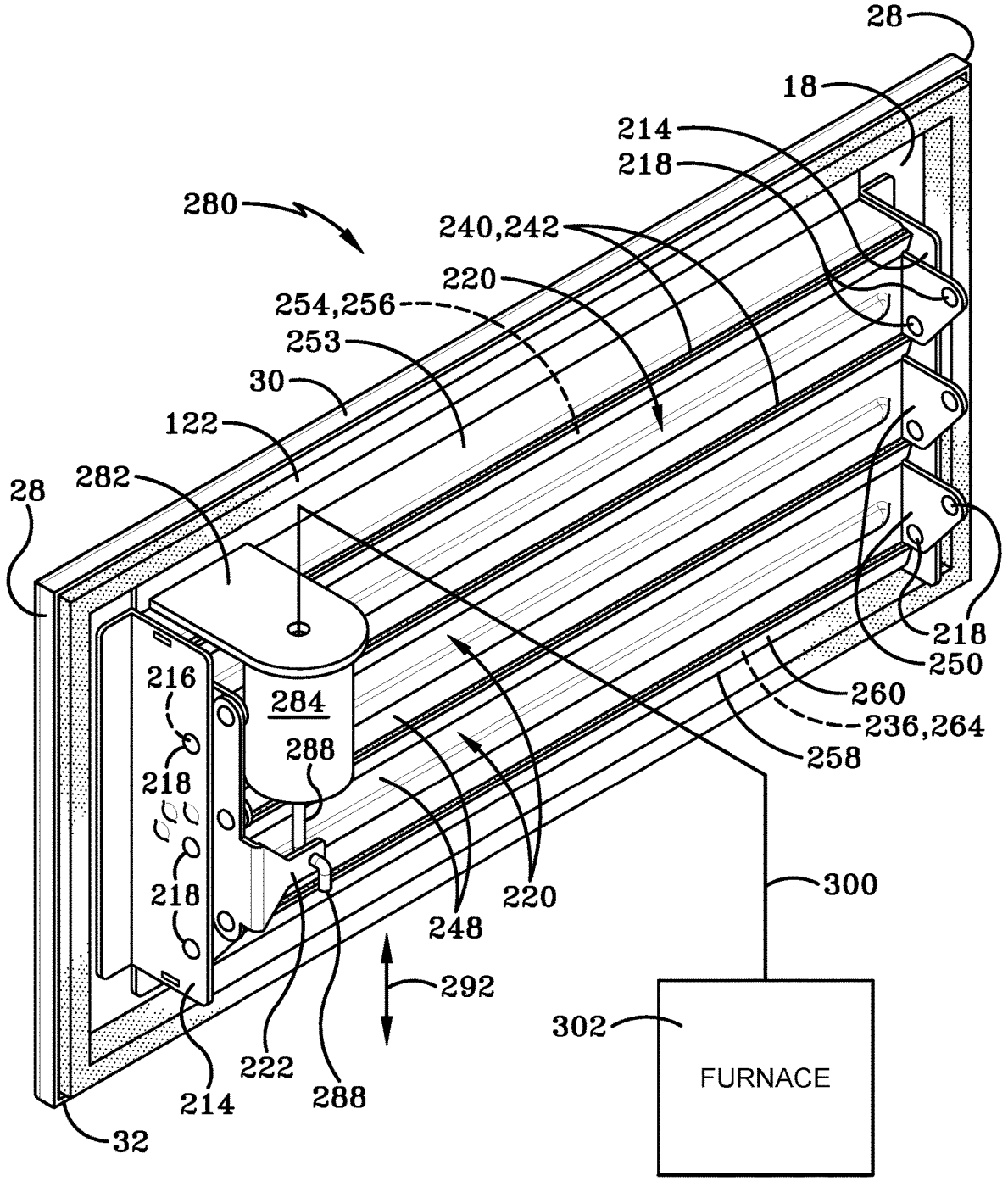
FIG. 34 is an automated air register system with an internal louver actuator remotely connected to a controller on a furnace.

FIGS. 33-34 illustrate an actuator assembly 278 mounted to an air register 280 at a mount 282. An actuator 284 moves actuator shaft 286 and louver controller shaft 286 which may be connected through louver controller aperture 290 to move the pivot mechanism 222 in the directions associated with arrows 292. Louver controller aperture 290 may be present in currently available air registers such that a user will simply have to install the actuator and mounting structure to utilize the system. Further, a remote controller 294 may include an open button 296, a closed button 298, and any other suitable partially open buttons. Remote controller 294 may be connected to actuator assembly 278 wirelessly 300 via Bluetooth, wi-fi, or any other suitable wireless or wired connection such as Ethernet, low voltage, or the like. While only open and closed buttons are shown, it is within the sprit to include various partially open positions which can be specifically selected. The remote controller 294 may instead be a furnace/air handler, home automation system, or a thermostat which selectively controls the opening and closing of the air register depending upon if the furnace blower is currently operating such that the air register should be open and if the furnace blower is not currently operating such that the air register should be closed. One key advantage of this structure is that currently installed air registers can be utilized to automatically open and close the air registers throughout the home when needed. Nevertheless, even greater energy efficiency can be obtained by utilizing the remote activated air register operation with a gasketed air register of the present disclosure.

FIG. 34 incorporates actuator 284 inside the air ductwork for a more aesthetically pleasing appearance and is specifically shown connected remotely to a furnace 302, although any of the previously disclosed controlling mechanisms may be utilized with the internal or external louver actuator systems. Still further, the remote or automated actuator system may be utilized with any number of air register designs beyond those specifically shown or described in this disclosure so long as the air register louvers can be opened selectively by the system as determined by the method of operation.

In operation, it may be preferred to have the louvers fully open when the air handler blower is active and the louvers fully closed when the air handler blower is inactive. Still further, it may be that only a limited number of rooms are being used and the system may open only the necessary air registers to more efficiently provide conditioned air. As can be seen, there are a number of possibilities for system customization.

In summary, the air registers disclosed provide more energy efficient ways to seal the conditioned space from the ductwork and the exterior spaces without changing the structure of the air register from the consumer's perspective. Further, the various aspects provide unique and efficient ways to reduce energy loss as well as a system which is able to further reduce energy consumption by more efficiently and selectively sealing various air registers.

It will be understood that implementations are not limited to the specific components disclosed herein, as virtually any components consistent with the intended operation of a method and/or system implementation for an air register may be utilized. Components may comprise any shape, size, style, type, model, version, class, grade, measurement, concentration, material, weight, quantity, and/or the like consistent with the intended operation of a method and/or system implementation for an air register.

The concepts disclosed herein are not limited to the specific implementations shown herein. For example, it is specifically contemplated that the components included in a particular implementation of an air register may be formed of any of many different types of materials or combinations that can readily be formed into shaped objects and that are consistent with the intended operation of an air register. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments of the air register may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations of an air register, it should be readily apparent that a number of modifications may be made without departing from the spirit thereof and that these implementations may be applied to other air registers. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

We claim:

1. An air register comprising:

a body having a front plate with a front surface, a rear surface, and at least one opening extending from the front surface to the rear surface;

an upper air dam having an arcuate first central portion comprising a leading edge and a trailing edge, the arcuate central portion comprising an outer surface;

a lower air dam having an arcuate second central portion a leading edge and a trailing edge, the arcuate second central portion comprising an outer surface;

an upper air deflector comprising a first forward lip, a first rear edge and a bottom surface positioned immediately adjacent and in contact with the arcuate first central portion of the upper air dam;

a lower air deflector comprising a second forward lip, a second rear edge and a top surface positioned immediately adjacent and in contact with the second central portion of the lower air dam;

an air flow control mechanism operatively connected to the upper air dam or the lower air dam to rotate both the upper air dam and the lower air dam simultaneously; and, wherein the upper air dam and the lower air dam rotate in opposite directions upon operation of the air flow control mechanism from an open position to a closed position in which the first trailing edge and the second trailing edge are in direct contact with each other or overlap each other; and in which the first forward lip overlaps with the first rear edge and the second forward lip overlaps with the second rear edge.

2. The air register of claim 1 wherein the upper air dam and the lower air dam each further comprise a rounded portion at each end.

3. The air register of claim 2 wherein each of the rounded portions further comprises a plurality of teeth.

4. The air register of claim 3 wherein the plurality of teeth engage each other to provide the rotation of the upper air dam and the lower air dam.

5. The air register of claim 1 wherein the upper air dam and the lower air dam rotate towards each other to restrict air flow through the at least one opening.

6. The air register of claim 1 wherein air does not flow through the at least one opening when the upper air dam trailing edge and lower air dam trailing edge are in contact with each other.

7. The air register of claim 1 wherein the upper air dam rotates within the upper air deflector and the lower air dam rotates within the lower air deflector.

8. The air register of claim 1 wherein the upper air dam further comprises a pin aperture.

9. The air register of claim 8 wherein the air flow control mechanism further comprises a pin.

10. The air register of claim 9 wherein the pin extends through the pin aperture and causes rotation of the upper air dam upon rotation of the air flow control mechanism.

11. The air register of claim 1 wherein the upper air deflector and the lower air deflector contact a duct upon installing the air register.

12. The air register of claim 1 wherein the upper air dam, the upper air deflector, the lower air dam, and the lower air deflector together prevent air flow through the at least one opening when the trailing edge of the upper air dam contacts the trailing edge of the lower air dam.

13. The air register of claim 1 wherein there are no more air dams than the upper air dam and the lower air dam.

14. The air register of claim 13 wherein all of the air passing through the air register only passes between the upper air dam and the lower air dam.

15. The air register of claim 1 further comprising a perimeter gasket.

16. The air register of claim 1 further comprising an end cap on opposing sides of the upper air dam and the lower air dam.

17. The air register of claim 16 wherein the upper air dam and the lower air dam are each connected to each end cap.

18. The air register of claim 1 wherein the air flow control mechanism extends forward of the front surface.

19. The air register of claim 1 further comprising a plurality of vertical vanes and wherein the upper air dam and the lower air dam are oriented horizontal.

20. The air register of claim 1 wherein the bottom surface of the upper air deflector has an arcuate bottom surface complementary to the arcuate first central portion and the top surface of the lower air deflector has an arcuate top surface complementary to the arcuate second central portion.

* * * * *